US007451981B2

(12) United States Patent
Taguchi et al.

(10) Patent No.: US 7,451,981 B2
(45) Date of Patent: Nov. 18, 2008

(54) SHEET CONVEYING DEVICE

(75) Inventors: Noriaki Taguchi, Yamatokoriyama (JP); Toshiki Takiguchi, Yamatokoriyama (JP); Hiroyuki Murai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 395 days.

(21) Appl. No.: 11/251,863

(22) Filed: Oct. 18, 2005

(65) Prior Publication Data

US 2006/0082051 A1 Apr. 20, 2006

(30) Foreign Application Priority Data

Oct. 19, 2004 (JP) ..... P2004-304583

(51) Int. Cl.
*B65H 9/00* (2006.01)

(52) U.S. Cl. ..... 271/226

(58) Field of Classification Search ..... 271/245, 271/226

See application file for complete search history.

(56) References Cited

U.S. PATENT DOCUMENTS 5,233,400 A * 8/1993 Cahill ..... 399/395
6,152,628 A * 11/2000 Satoh et al. ..... 400/579

FOREIGN PATENT DOCUMENTS

JP 57-90346 A 6/1982
JP 62-222949 A 9/1987
JP 9-278243 A 10/1997
JP 2000-351491 A 12/2000

* cited by examiner

*Primary Examiner*—Kaitlin S Joerger
(74) *Attorney, Agent, or Firm*—Birch, Stewart, Kolasch & Birch, LLP

(57) ABSTRACT

A sheet conveying device that facilitates solution of a jam of a sheet and which is capable of inhibiting shortening of life due to a jam is provided. A sheet having a bent leading end that is very likely to jam is positively made to jam at a blocking portion formed on an upstream side of an image forming station in a sheet conveying direction thereof. Consequently, it is possible to more easily perform an operation of solving a jam than in a case where a jam of the sheet occurs in the image forming station. Moreover, it is possible to prevent deterioration of the image forming station due to a jam, and inhibit shortening of the life of the image forming station resulting from a jam.

13 Claims, 13 Drawing Sheets

SHEET CONVEYING DEVICE

BACKGROUND OF THE INVENTION

1. Field of the Invention

The present invention relates to a sheet conveying device that conveys various kinds of sheets, more specifically, relates to a sheet conveying device that conveys a manually fed sheet.

2. Description of the Related Art

Conventionally there has been utilized an image forming apparatuses that forms an image on a various kinds of manually fed sheets such as a small-size sheet, a nonstandard-size sheet, thick paper and thin paper, which cannot be fed in a paper feeding cassette.

Further, there is a case where a sheet such that an image is already formed on one surface thereof, so-called backing paper, is manually fed for the purpose of reuse of a sheet. Backing paper easily causes sheet obstruction, that is, a jam in an image forming apparatus, because a curl, a fold or the mark of a stapler is formed on backing paper.

Japanese Unexamined Patent Publication JP-A 9-278243 (1997) discloses a technique for straightening a curl by curling rolled recording paper in a specified manner. According to this technique, by nipping a leading end of the recording paper with nip portions of a feed roller and a sponge roller, a curl in a rolled direction of the rolled recording paper is straightened, and a jam and a skew in a conveying path are prevented.

Further, Japanese Unexamined Patent Publication JP-A 2000-351491 discloses a technique for supplying a rolled sheet. In this technique, a sheet releasing separator which releases the leading end of the sheet rolled like a roll is used. The sheet releasing separator is divided into plural parts, and energized by springs. Consequently, even when the tip of the rolled sheet is curled, or even when the section of the recording paper is not good, the recording paper is stably conveyed, and occurrence of a jam is prevented.

The aforementioned art is a technique relating to a rolled sheet, and it is assumed that the paper quality of the sheet is constant at all times. Therefore, there is no description of prevention of a jam of sheets of different paper qualities or backing paper on which a fold or the mark of a stapler is formed. Accordingly, it is difficult to prevent a jam of various kinds of manually fed sheets by the aforementioned art.

For example, even if it is tried to curl sheets to prevent a jam as in JP-A 9-278243, manually fed sheets are curled too much or too little because the paper qualities thereof are not constant, and a jam occurs after all. Moreover, it is difficult to curl to prevent a jam in the case of a sheet whose tip is folded. Furthermore, in the case of guiding a sheet by the use of a plurality of separators as in JP-A 2000-351491, there is a fear that a sheet jams on a downstream side of the separators in the sheet conveying direction when a skew of the tip of the sheet is not solved.

Accordingly, in the aforementioned related arts, in a case where an arbitrary kind of sheet such as a manually fed sheet is fed, there is no guarantee that it is possible to convey while preventing a jam. In a case where a jam occurs inside an apparatus, it takes time and effort to solve the jam. Moreover, in a case where a jam frequently occurs inside an apparatus, the life thereof gets shortened, and it becomes hard to carry out maintenance. Furthermore, these problems also occur generally in sheet processing apparatuses equipped with sheet conveying devices.

SUMMARY OF THE INVENTION

Hence, an object of the invention is to provide a sheet conveying device capable of facilitating solution of sheet jam of a sheet and inhibiting shortening of life due to a jam.

The invention provides a sheet conveying device comprising: conveying means for conveying a sheet; and guiding means positioned on a downstream side of the conveying means in a sheet conveying direction thereof, for guiding the sheet conveyed by the conveying means in the sheet conveying direction, the guiding means having a blocking portion against which, when a sheet having a bent leading end is conveyed, the bent leading end of the sheet abuts.

According to the invention, a sheet is guided by the guiding means and is conveyed in the sheet conveying direction. The conveying means conveys various kinds of sheets, namely, the conveying means conveys both a sheet having a bent leading end and a flat sheet which is flat overall.

In the case of conveying a sheet having a bent leading end, the bent leading end abuts against the blocking portion. Consequently, the sheet having the bent leading end is prevented from moving in the sheet conveying direction, and obstructed, that is, jammed at the blocking portion. Therefore, it is possible to prevent the sheet having the bent leading end from jamming on a downstream side of the guiding means in the sheet conveying direction. On the other hand, in the case of conveying a flat sheet, the flat sheet is conveyed without abutting against the blocking portion, and therefore, conveyed in the sheet conveying direction without jamming.

Thus, according to the invention, a sheet having a bent leading end which is very likely to jam is positively jammed at the blocking portion. Therefore, even when the sheet having the bent leading end and a flat sheet are conveyed in a mixed state, it is possible to prevent the sheet having the bent leading end from being conveyed to the downstream side of the guiding means in the sheet conveying direction thereof, and it is possible to reduce the possibility that the sheet jams on the downstream side of the guiding means in the sheet conveying direction.

By causing a jam at the guiding means, it is possible to facilitate an operation of solving a jam as compared with in a case where a jam occurs on the downstream side of the guiding means in the sheet conveying direction thereof. For example, in a case where the image forming means is placed on the downstream side of the guiding means in the sheet conveying direction thereof, it is possible to prevent a sheet from jamming in the image forming means and easily perform an operation of solving a jam, and it is possible to prevent deterioration of the image forming means due to a jam and inhibit shortening of the life of the image forming means resulting from a jam.

In the invention, it is preferable that the guiding means has a sheet guiding surface which faces one surface in a thickness direction of the sheet conveyed by the conveying means; and the blocking portion protrudes or retracts from the sheet guiding surface.

Further, according to the invention, a sheet having a bent leading end and a flat sheet move along the sheet guiding surface. The bent leading end of the sheet protrudes in a direction crossing the sheet conveying direction with respect to the remaining portion. When the sheet having the bent leading end is conveyed in the sheet conveying direction along the sheet guiding surface, the bent leading end of the sheet is caught by the blocking portion, and movement of the sheet is prevented. On the other hand, since the leading end of the flat sheet is straight in the sheet conveying direction, the sheet is prevented from abutting against the blocking portion.

By making the blocking portion protrude or retract from the sheet guiding surface, it is possible to make the bent leading end of the sheet abut against the blocking portion, and it is possible to make a flat sheet pass by without making the leading end thereof abut against the blocking portion. Therefore, it is possible to achieve both prevention of movement of a sheet having a bent leading end and allowance of movement of a flat sheet by the blocking portion In the invention, it is preferable that the guiding means has two sheet guiding surfaces which face both surfaces in the thickness direction of the conveyed sheet, respectively; and the blocking portion protrudes or retracts from each of the sheet guiding surfaces.

Further, according to the invention, the sheet guiding surfaces are formed on both the sides in the thickness direction of a sheet, and the blocking portions are formed on the respective sheet guiding surfaces. Consequently, whichever direction in sheet thickness direction a sheet is bent in, it is possible to make the sheet jammed by the blocking means. Consequently, it is possible to more securely prevent a sheet having a bent leading end from moving to the downstream side of the guiding means of the guiding means in the sheet conveying direction, and more securely prevent a jam from occurring on the downstream side of the guiding means in the sheet conveying direction.

In the invention, it is preferable that the blocking portion is formed into a concave shape so as to retract from the sheet guiding surface and formed so that an angle formed by a surface on a downstream side of the blocking portion in the sheet conveying direction and the sheet guiding surface is 90 degrees or less.

Further, according to the invention, the blocking portion is formed into a concave shape. In this case, the bent leading end of a sheet moves along the sheet guiding surface, fits into a concavity formed by the blocking portion, and abuts against the surface thereof on the downstream side in the sheet conveying direction. Since the surface on the downstream side of the blocking portion in the sheet conveying direction and the sheet guiding surface are formed so as to form an angle of 90 degrees or less, it is possible to prevent the bent leading end of a sheet from escaping from the concavity, and it is possible to more securely prevent the sheet from going downstream in the sheet conveying direction from the blocking portion.

In the invention, it is preferable that the blocking portion is formed into a convex shape so as to protrude from the sheet guiding surface and formed so that an angle formed by a surface on an upstream side of the blocking portion in the sheet conveying direction and the sheet guiding surface is 90 degrees or less.

Further, according to the invention, the blocking portion is formed into a convex shape. In this case, the bent leading end of a sheet moves along the sheet guiding surface, and abuts against a surface on the upstream side of the blocking portion in the sheet conveying direction. Since the surface on the upstream side of the blocking portion in the sheet conveying direction and the sheet guiding surface are formed so as to form an angle of 90 degrees or less, it is possible to prevent the bent leading end of a sheet from climbing over the convex portion of the blocking portion, and it is possible to more securely prevent the sheet from going downstream in the sheet conveying direction from the blocking portion.

In the invention, it is preferable that the blocking portion is formed so as to have a larger length in an orthogonal direction which intersects the sheet conveying direction at right angles than a length in the orthogonal direction of the conveyed sheet.

Further, according to the invention, the length in the orthogonal direction of the blocking portion is selected so as to be larger than the length in the orthogonal direction of a conveyed sheet. Consequently, even if a bent part of the leading end of a sheet is formed at a part in the orthogonal direction, for example, at the end in the orthogonal direction, the bent portion surely abuts against the blocking portion. Therefore, it is possible to more securely prevent the sheet from moving to the downstream side of the blocking portion in the sheet conveying direction.

In the invention, it is preferable that a manually fed sheet is conveyed.

Further, according to the invention, the conveying means conveys a manually fed sheet. It is relatively common that manually fed sheets have burrs, flaps, warps, folds and the like at the tips thereof. Moreover, the manually fed sheets are of various materials and shapes. Therefore, manually fed sheets are very likely to jam. A sheet having a burrs, flap, warp, fold and the like in its leading end among the manually fed sheets abuts against the blocking portion, and is prevented from moving to the downstream side of the blocking portion in the sheet conveying direction. Consequently, it is possible to inhibit the manually fed sheets in which a sheet having a bent leading end and a flat sheet are easily mixed from jamming on the downstream side of the guiding means in the sheet conveying direction.

In the invention, it is preferable that the sheet conveying device further comprises controlling means for controlling the conveying means; and a jam detecting sensor for detecting that conveyance of the sheet is prevented by the blocking portion, and the controlling means stops a sheet conveying operation of the conveying means when determining that conveyance of the sheet is prevented based on a signal outputted from the jam detecting sensor.

Further, according to the invention, when the bent leading end of a sheet abuts against the blocking portion and a jam occurs, the jam detecting sensor detects occurrence of the jam, and gives the controlling means a signal that represents occurrence of the jam. When receiving the signal that represents occurrence of the jam from the jam detecting sensor, the controlling means stops a sheet conveying operation performed by the conveying means. Consequently, it is possible to prevent the jam from progressing after occurrence of the jam is detected, and easily solve the jam.

The invention provides an image forming apparatus comprising: conveying means for conveying a sheet in a sheet conveying direction; guiding means positioned on a downstream side of the conveying means in the sheet conveying direction, for guiding the sheet conveyed by the conveying means; and image forming means positioned on a downstream side of the guiding means in the sheet conveying direction, for forming an image on the sheet, wherein the guiding means has a blocking portion against which, when a sheet having a bent leading end is conveyed, the bent leading end of the sheet abuts.

Further, according to the invention, a sheet conveyed by the conveying means is guided by the guiding means, and conveyed toward the image forming means. The conveying means conveys various kinds of sheets, and conveys both a sheet having a bent leading end and a flat sheet which is flat overall. In the case of conveying the sheet having the bent leading end, the bent leading end of the sheet abuts against the blocking portion from the upstream side in the sheet conveying direction. The sheet having the bent leading end is prevented from moving toward the image forming means by the blocking portion, and a jam occurs on the upstream side of the blocking portion in the sheet conveying direction. By thus making a sheet having a bent leading end jam on the upstream side of the blocking portion in the sheet conveying direction, it is possible to prevent the sheet having the bent leading end from jamming in the image forming means. On the other hand, in the case of conveying a flat sheet, the flat sheet is conveyed without abutting against the blocking portion, so that the sheet is conveyed toward the image forming means.

Thus, according to the invention, even if a sheet having a bent leading end and a flat sheet are conveyed in a mixed state, it is possible to prevent the sheet having the bent leading end that is very likely to jam from being conveyed to the image forming means, and reduce the possibility that the sheet jams in the image forming means. Moreover, by causing a jam at the guiding means, it is possible to facilitate an operation of solving a jam as compared with in a case where a jam occurs in the image forming means.

In the invention, it is preferable that the image forming apparatus further comprises a manually fed sheet storing portion which is exposed to outside of the apparatus, for storing sheets, and the conveying means has a roller for taking out a sheet stored in the manually fed sheet storing portion into the apparatus and driving means for rotating the roller.

Further, according to the invention, the conveying means has the take-out roller for taking out a sheet stored in the manually fed sheet storing portion into the apparatus and the driving means therefor. In this case, when a sheet having a bent leading end is prevented from moving by the blocking portion, the sheet having the bent leading end jams before being thoroughly taken out into the apparatus. The operator can solve the jam by pulling the jammed sheet from the outside of the apparatus. Therefore, the operator does not need to open the inside of the apparatus to take out the jammed sheet, and it is possible to further facilitate solution of a jam.

In the invention, it is preferable that the image forming apparatus further comprises: controlling means for controlling the image forming means and the conveying means; and a jam detecting sensor for detecting that conveyance of the sheet is prevented by the blocking portion, and the controlling means stops a sheet conveying operation performed by the conveying means and stops an image forming operation performed by the image forming means when determining that conveyance of the sheet is prevented based on a signal outputted from the jam detecting sensor.

Further, according to the invention, when the bent leading end of a sheet abuts against the blocking portion and a jam occurs, the jam detecting sensor detects occurrence of the jam. Then, the controlling means controls the image forming means and the conveying means so as to perform a predetermined jam handling operation. In concrete, after occurrence of a jam is detected, conveyance of a sheet is stopped to prevent the jam from progressing, and stops an image forming operation. Consequently, it is possible to easily solve a jam, and it is possible to prevent an unnecessary image forming operation.

In the invention, it is preferable that the image forming apparatus further comprises controlling means for controlling the image forming means and the conveying means, and the conveying means has a pair of rollers for conveying the sheet while cooperatively nipping the sheet, and driving means for rotating at least one roller of the pair of rollers; in a case where successive image formation on a plurality of sheets is made, the controlling means causes the conveying means to stand by in a state in which a second sheet protrudes by a predetermined take-out amount in the sheet conveying direction from a position between the pair of rollers while causing the image forming means to form an image on a first sheet, and the controlling means causes the conveying means to convey the second sheet toward the image forming means after causing the image forming means to form an image on the first sheet; and the blocking portion is formed in a position three times or more and five times or less the take-out amount away from the position between the pair of rollers.

Further, according to the invention, in a case where images are successively formed on a plurality of sheets, the conveying means stands by in a state in which a sheet protrudes by a predetermined take-out amount from the position between the pair of rollers while being nipped therebetween, and when it is brought into an image formable state, the sheet nipped between the rollers is conveyed toward the image forming means. By causing the conveying means to stand by in a state in which a sheet is nipped between the rollers, it is possible to convey the sheet toward the image forming means in a short time, and it is possible to increase the number of processed sheets on which images can be formed per unit time. Moreover, since the blocking portion is formed in a position three times or more and five times or less the take-out amount away from a position between the pair of rollers, it is possible to securely prevent a jam of a sheet having a bent leading end even if the paper qualities of the sheets are different, for example, thick paper, thin paper and the like.

In the invention, it is preferable that the blocking portion is further disposed on an upstream side of the pair of rollers in the sheet conveying direction.

Further, according to the invention, since the bent leading end of the sheet abuts against the blocking portion on the upstream side of the pair of rollers in the sheet conveying direction, it is possible to make a larger part of the sheet remain outside the apparatus when a jam occurs, and it is possible to more easily solve the jam.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
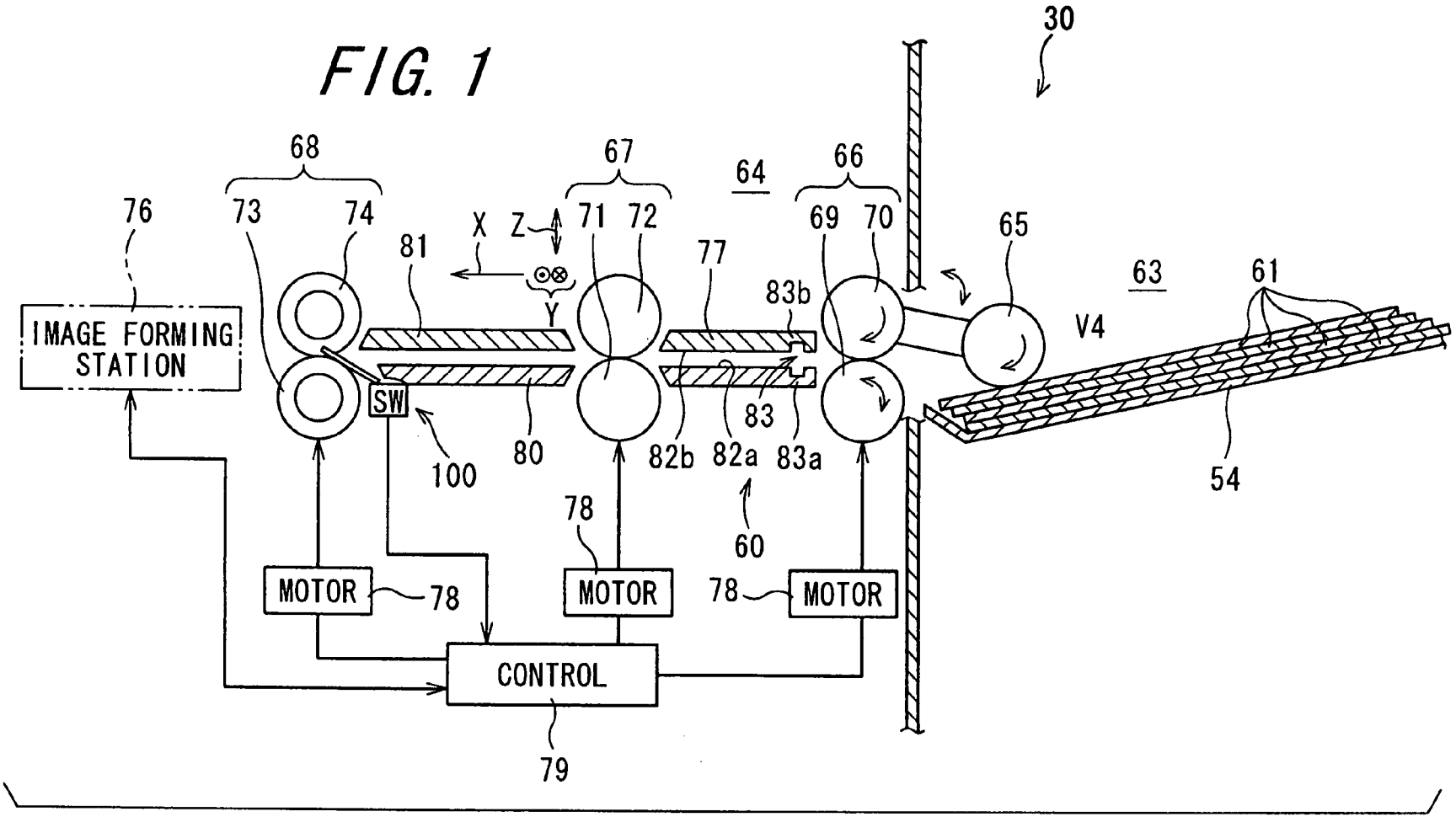
FIG. 1 is a cross section view showing part of an image forming apparatus according to a first embodiment of the invention.

Now referring to the drawings, preferred embodiments of the invention are described below.

FIG. 1 is a cross section view showing part of an image forming apparatus 30 according to a first embodiment of the invention. The image forming apparatus 30 of the present embodiment is capable of forming an image on a manually fed sheet 61, and has a manually fed sheet conveying device 60 that conveys the manually fed sheet 61 toward an image forming station 76. In other words, the manually fed sheet conveying device 60 forms part of the image forming apparatus 30.

The image forming apparatus 30 is equipped with a manual-bypass tray 54 that stores the manually fed sheet 61 and is a manually fed sheet storing portion. The manual-bypass tray 54 projects into an outer space 63 of the image forming apparatus 30, and stores an arbitrary kind of sheet supplied by the operator in image formation. The manual-bypass tray 54 stores not only sheets of uniform quality and shape but also various kinds of sheets. For example, there is a case where the manual-bypass tray 54 stores reused paper on which a curl, a fold, the mark of a stapler or the like is formed, that is, backing paper, as well as nonstandard-size sheets, sheets of random paper qualities like thickness and strength, sheets whose cross section shapes in the sheet thickness direction are not uniform, and so on.

The manually fed sheet conveying device 60 of the image forming apparatus 30 comprises a take-out roller 65, a pair of delivery rollers 66, a pair of intermediate rollers 67, a pair of paper stop rollers 68 (referred to as the pair of PS rollers 68 hereinafter), and guiding means 77. The take-out roller 65, the pair of delivery rollers 66, the pair of intermediate rollers 67 and the pair of paper stop rollers 68 constitute conveying means.

The take-out roller 65, the pair of delivery rollers 66, the pair of intermediate rollers 67 and the pair of paper stop rollers 68 line up in this order along a sheet conveying direction X. The take-out roller 65 takes out one or a plurality of sheets 61 stored in the manual-bypass tray 54 into the apparatus, and conveys toward an inner space 64 of the manually fed sheet conveying device 60.

The pair of delivery rollers 66 pick out one sheet 61 from among the one or plurality of sheets 61 taken out by the take-out roller 65, and conveys the one sheet 61 in the sheet conveying direction X. The sheet 61 conveyed by the pair of delivery rollers 66 is conveyed to the pair of PS rollers 68 via the pair of intermediate rollers 67.

The pair of PS rollers 68 convey the sheet 61 toward the image forming station 76 serving as image forming means at an image forming timing and an image forming speed, that is, a process speed of the image forming station 76. The guiding means 77 guides the sheet 61 so that the sheet 61 conveyed from the manual-bypass tray 54 toward the image forming station 76 does not miss a conveying path.

The respective rollers 65, 69, 70, 71, 72, 73 and 74 composing the take-out roller 65, the pair of delivery rollers 66, the pair of intermediate rollers 67 and the pair of PS rollers 68 are positioned along the conveying path of the manually fed sheet 61, and the axial lines of the respective rollers extend in an orthogonal direction Y that intersects the sheet conveying direction X at right angles. The respective rollers 65, 69 to 74 are supported so as to be rotatable around the axial lines in a housing of the image forming apparatus 30. The respective rollers 65, 69 to 74 are rotated by a motor 78 serving as driving means. The motor 78 is controlled by controlling means 79. The motor 78 may be disposed for each roller, or may drive some of the rollers 65, 69 to 74 simultaneously by the use of a power transmission mechanism.

The take-out roller 65 is located in a position opposed to the manual-bypass tray 54, and disposed so as to be rotatable around the axial line as well as so as to be capable of moving close to the manual-bypass tray 54 and moving away therefrom. The take-out roller 65 is realized by rubber resin.

The pair of delivery rollers 66 are formed by a separating roller 69 and a paper-feeding roller 70, which are opposed to each other. The separating roller 69 is disposed so as to be capable of normally rotating and reversely rotating around the axial line, and the paper-feeding roller 70 is disposed so as to be capable of normally rotating. The separating roller 69 and the paper-feeding roller 70 are realized by rubber resin, and located in a state in which parts of the outer peripheral surfaces thereof abut against or are close to each other.

The pair of intermediate rollers 67 are formed by a first intermediate roller 71 and a second intermediate roller 72, which are opposed to each other. The respective intermediate rollers 71, 72 are disposed so as to be capable of normally rotating around the axial lines, and located in a state in which parts of the outer peripheral surfaces thereof abut against or are close to each other. The respective intermediate rollers 71, 72 are realized by rubber resin.

The pair of PS rollers 68 are formed by a first PS roller 73 and a second PS roller 74. The first PS roller 73 is realized by rubber resin, and the second PS roller 74 is realized by metal. The respective PS rollers 73, 74 are located in a state in which parts of the outer peripheral surfaces thereof abut against or are close to each other. In the present embodiment, the first PS roller 73 is formed so as to be capable of normally rotating, and the second PS roller 74 is disposed so as to be capable of reversely rotating. The rubber resin used for the respective rollers 65, 69 to 73 mentioned above is realized by, for example, EPDM (ethylene propylene rubber). In the present specification, normal rotation is rotation in a direction to convey a sheet in the sheet conveying direction X, and reverse rotation is rotation in a direction to convey a sheet in the opposite direction to the sheet conveying direction X.

The take-out roller 65 is located in a position a predetermined distance away from the manual-bypass tray 54 when image formation is not performed. In concrete, the take-out roller is located at an interval such that the manually fed sheet 61 can be stored between the manual-bypass tray 54 and the take-out roller 65.

In conveyance of a sheet, the take-out roller 65 moves toward the manual-bypass tray 54, and the outer peripheral surface thereof comes in contact with the sheet 61 stored in the manual-bypass tray 54. Then, the take-out roller 65 holds the manually fed sheet 61 in cooperation with the manual-bypass tray 54. In this state, the take-out roller 65 moves the manually fed sheet 61 that is in contact with the outer peripheral surface thereof along the sheet conveying direction X by normally rotating, and guides the leading end of the one or plurality of sheets 61 to between the separating roller 69 and the paper-feeding roller 70.

In a state in which the leading end of the one or plurality of sheets 61 is conveyed to between the separating roller 69 and the paper-feeding roller 70 by the take-out roller 65, the paper-feeding roller 70 normally rotates, and the separating roller 69 reversely rotates. Then, one sheet that is in contact with the paper-feeding roller 70 is conveyed in the sheet conveying direction X, and the remaining sheets are moved in the opposite direction to the sheet conveying direction X.

After the remaining sheets are pushed out in a state in which the one sheet of the one or plurality of sheets taken out by the take-out roller 65 is nipped between the separating roller 69 and the paper-feeding roller 70 in this way, both the paper-feeding roller 70 and the separating roller 69 are caused to normally rotate, and only the one sheet nipped therebetween is conveyed in the sheet conveying direction X.

The sheet conveyed by the pair of delivery rollers 66 is conveyed to between the intermediate rollers 71, 72. By normal rotation of the respective intermediate rollers 71, 72, the sheet 61 is moved in the sheet conveying direction X, and conveyed toward the pair of PS rollers 68.

The pair of PS rollers 68 solve a skew movement of the sheet 61 by temporarily blocking the sheet 61 conveyed by the pair of intermediate rollers 67, and stand by in a state in which the sheet 61 is nipped between the PS rollers 73, 74. In this state, the pair of PS rollers 68 start conveyance of the sheet 61 nipped therebetween so as to synchronize with the image forming timing of the image forming station 76.

The guiding means 77 extends along the sheet conveying direction X, and forms a conveying path of a sheet. In concrete, the guiding means includes a first guiding member 80 formed on one side in a thickness direction Z of a sheet conveyed by the respective rollers, and a second guiding member 81 is formed on the other side in the thickness direction Z of the conveyed sheet. The first guiding member 80 and the second guiding member 81 are positioned at an interval of the thickness of the sheet or more. The respective guiding members 80, 81 extend along the sheet conveying direction X, and extend along the width direction of the conveyed sheet, which is the orthogonal direction Y that intersects the sheet conveying direction X at right angles. The guiding member 77 is placed on a downstream side of at least the delivery rollers 66 in the sheet conveying direction.

Figure 2:
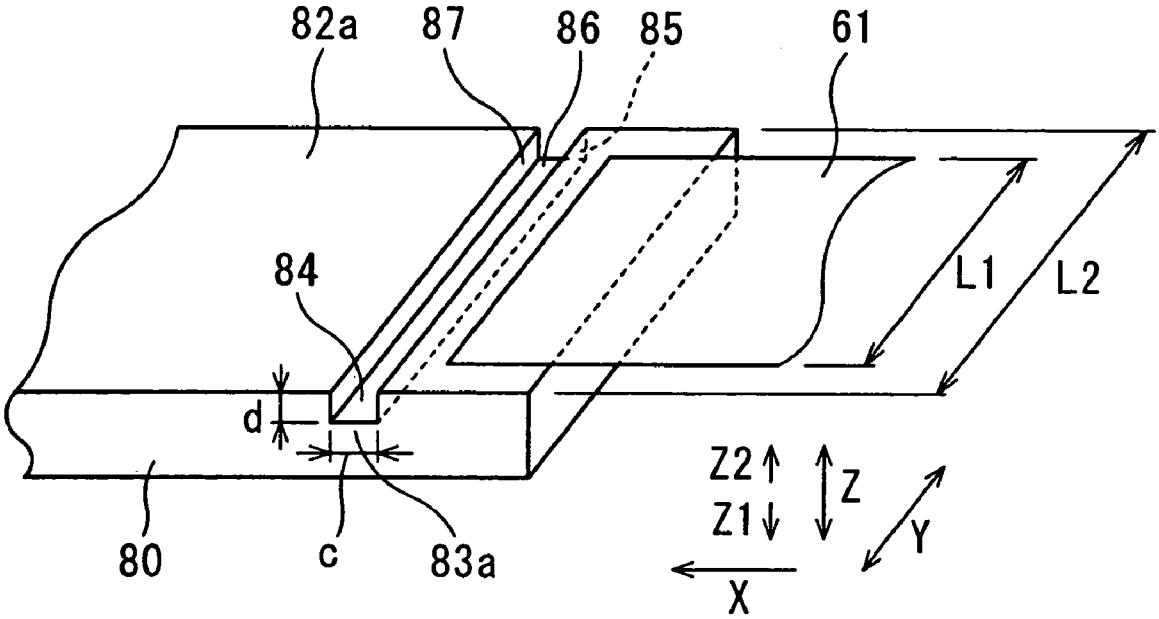
FIG. 2 is a perspective view showing the first guiding member.

FIG. 2 is a perspective view showing the first guiding member 80. In the present embodiment, the first guiding member 80 extends along the sheet conveying direction X from the downstream side of the pair of delivery rollers 66 in the sheet conveying direction. The first guiding member 80 is formed into a plate shape, and has a first sheet guiding surface 82*a* that faces a surface on one side in the thickness direction of the conveyed sheet 61.

Further, the first guiding member 80 has a first blocking portion 83*a* at a part close to the pair of delivery rollers 66. The first blocking portion 83*a* retracts from the first sheet guiding surface 82*a* in the thickness direction Z, which is the thickness direction of the conveyed sheet, and forms a concavity 84 that communicates with the conveying path. The first blocking portion 83*a* extends in the orthogonal direction Y, and has three concavity forming surfaces 85, 86, 87, which face the concavity 84. The first blocking portion 83*a* is formed so that, in the case of filling the concavity 84 of the first blocking portion 83*a* with a filling material, the shape of the filling material becomes an almost quadrangular prism that extends in the width direction Y.

The first blocking portion 83*a* has the first concavity forming surface 85, the second concavity forming surface 86 and the third concavity forming surface. The first concavity forming surface 85 is a surface on an upstream side in the sheet conveying direction, and is connected to the sheet guiding surface 82 and extends in one thickness direction Z1 from the first sheet guiding surface 82*a*. The one thickness direction Z1 is a direction retracting from the first sheet guiding surface 82*a* with respect to the thickness direction Z. The second concavity forming surface 86 is a surface extending almost in parallel to a conveyed sheet, and extends in the sheet conveying direction X from the edge in the one thickness direction Z1 of the first concavity forming surface 85. The third concavity forming surface 86 is a surface on the downstream side in the sheet conveying direction, and extends in the other thickness direction Z2 from the edge on the downstream side sheet conveying direction of the second concavity forming surface 86 in the sheet conveying direction and is connected to the first sheet guiding surface 82*a*. The other thickness direction Z2 is a direction protruding from the first sheet guiding surface 82*a* with respect to the thickness direction.

It is preferred that an angle formed by the second concavity forming surface 86 and the third concavity forming surface 87, and an angle formed by the third concavity forming surface 87 and the first sheet guiding surface 82*a*, are 90 degrees or less. In the present embodiment, an angle formed by the first sheet guiding surface 82*a* and the first concavity forming surface 85, an angle formed by the first concavity forming surface 85 and the second concavity forming surface 86, an angle formed by the second concavity forming surface 86 and the third concavity forming surface 87, and an angle formed by the third concavity forming surface 87 and the first sheet guiding surface 82*a*, are 90 degrees.

Further, the first blocking portion 83*a* extends over the conveyed sheet 61 in the orthogonal direction Y. That is to say, the first blocking portion 83*a* is formed so that a length L2 thereof in the orthogonal direction is larger than a length L1 in the orthogonal direction of a sheet. In the present embodiment, a depth d of the concavity 84 formed by the first blocking portion 83*a* is set to 1 mm, and a width c of the concavity 84 is set to 3 mm or more and 5 mm or less.

The second guiding member 81 is formed symmetrically with the first guiding member 80 with respect to the sheet conveying direction X. In concrete, the second guiding member 81 has a second sheet guiding surface 82*b* that faces a surface on the other side in the thickness direction of the conveyed sheet 61. Moreover, the second guiding member 81 has a second blocking portion 83*b* at a part close to the pair of delivery rollers 66. The second blocking portion 83*b* is positioned so as to be opposed to the first blocking portion 83*a*. The second blocking portion 83*b* retracts from the second sheet guiding surface 82*b* in the thickness direction Z, and forms the concavity 84 that communicates with the conveying path. Since the shape of the second guiding member 81 is almost the same as that of the first guiding member 80, the description thereof will be omitted. Note that the first blocking portion 83*a* and the second blocking portion 83*b* are occasionally collectively referred to as the blocking portion 83, and the first sheet guiding surface 82*a* and the second sheet guiding surface 82*b* are occasionally collectively referred to as the sheet guiding surface 82.

A sheet fed in the manual-bypass tray 54 may be a non-standard-size sheet, thick paper, or thin paper. Moreover, for the purpose of reuse of a sheet, backing paper such that an image is already formed on the surface thereof may be fed. There is a case where a curl, a fold or the mark of a stapler is formed on the backing paper, and the leading end of the sheet is bent more than the remaining part.

Accordingly, the image forming apparatus 30 is capable of storing a sheet having a bent leading end and a flat sheet which is flat overall in a mixed state in the manual-bypass tray 54. In the present embodiment, by making a sheet having a bent leading end jammed forcibly by the blocking portion 83, it is possible to prevent a sheet which is very likely to jam from being taken out into the apparatus, and prevent damage inside the apparatus and wasteful use of consumables.

Figure 3A:
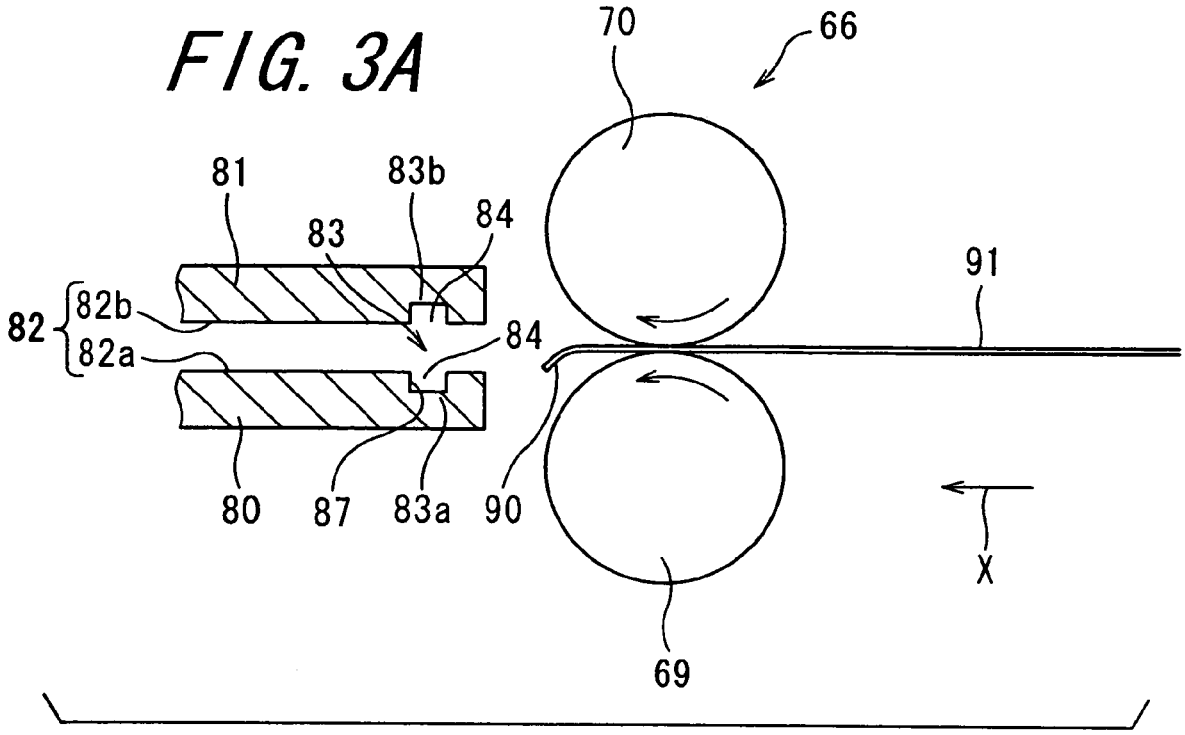
FIGS. 3A and 3B are cross section views showing a state in which a sheet having a bent leading end is conveyed.
Figure 3B:
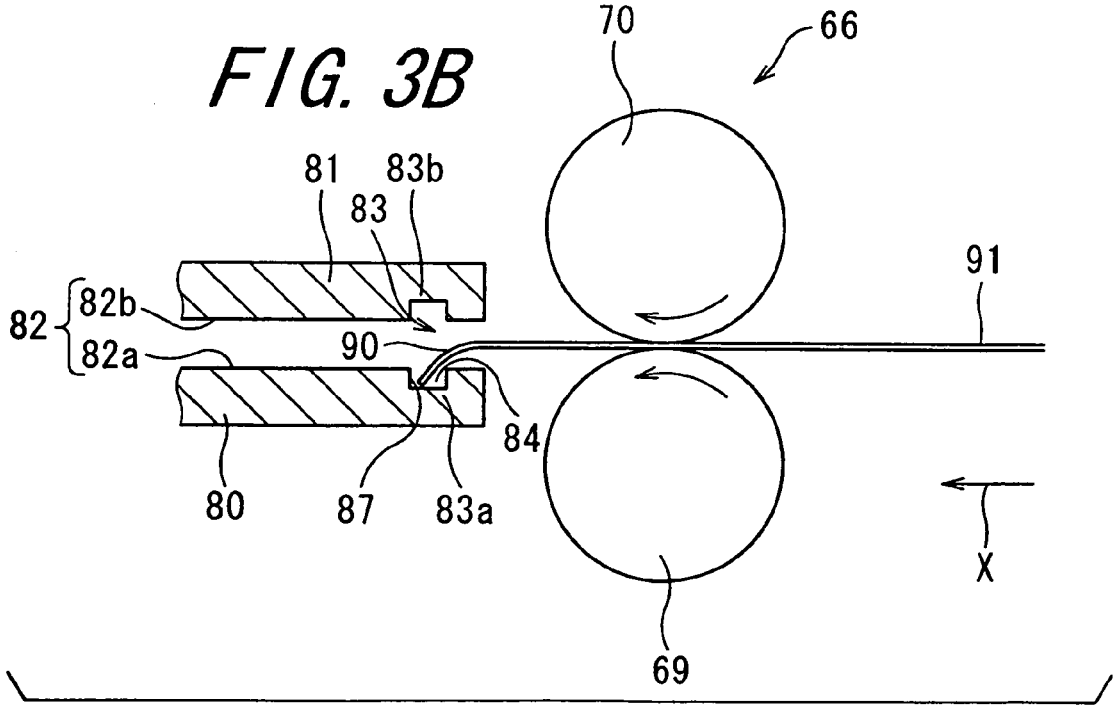

FIGS. 3A and 3B are cross section views showing a state in which a sheet 91 having a bent leading end 90 is conveyed. FIG. 3A shows a state in which the bent leading end 90 of the sheet 91 has not reached the blocking portion 83, and FIG. 3B shows a state in which the bent leading end 90 of the sheet 91 has reached the blocking portion 83.

In conveyance of a sheet, the pair of delivery rollers 66 nip the one sheet 91 guided by the take-out roller 65. By normal rotation of the separating roller 69 and the paper-feeding roller 70 in this state, the nipped sheet 91 is conveyed in the sheet conveying direction X. As shown in FIG. 3A, the bent leading end 90 of the sheet 91 is bent in a direction crossing the sheet conveying direction X.

When the sheet 91 having the bent leading end is conveyed in the sheet conveying direction X in this state, the sheet 91 having the bent leading end is conveyed in the sheet conveying direction X in a state in which the bent bent leading end 90 comes in contact with one of the guiding members 80, 81. As shown in FIG. 3B, when the bent leading end 90 reaches the blocking portion 83, the bent leading end 90 is caught in the concavity 84 formed by the blocking portion 83, and abuts against the surface on the downstream side of the blocking portion 83 in the sheet conveying direction, that is, the third concavity forming surface 87. Consequently, the bent leading end 90 of the sheet 91 is prevented from escaping from the blocking portion 83, and the sheet 90 is obstructed at the blocking portion 83.

Figure 4A:
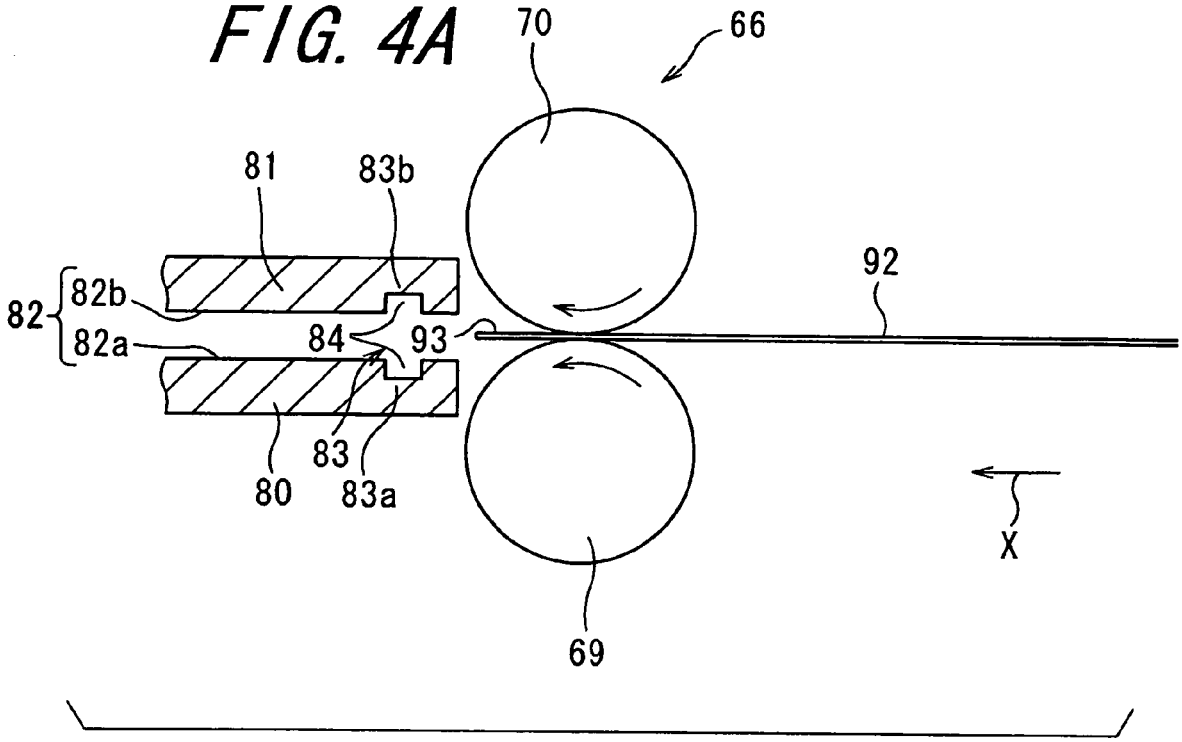
FIGS. 4A and 4B are cross section views showing a state in which a flat sheet that is flat overall is conveyed.
Figure 4B:
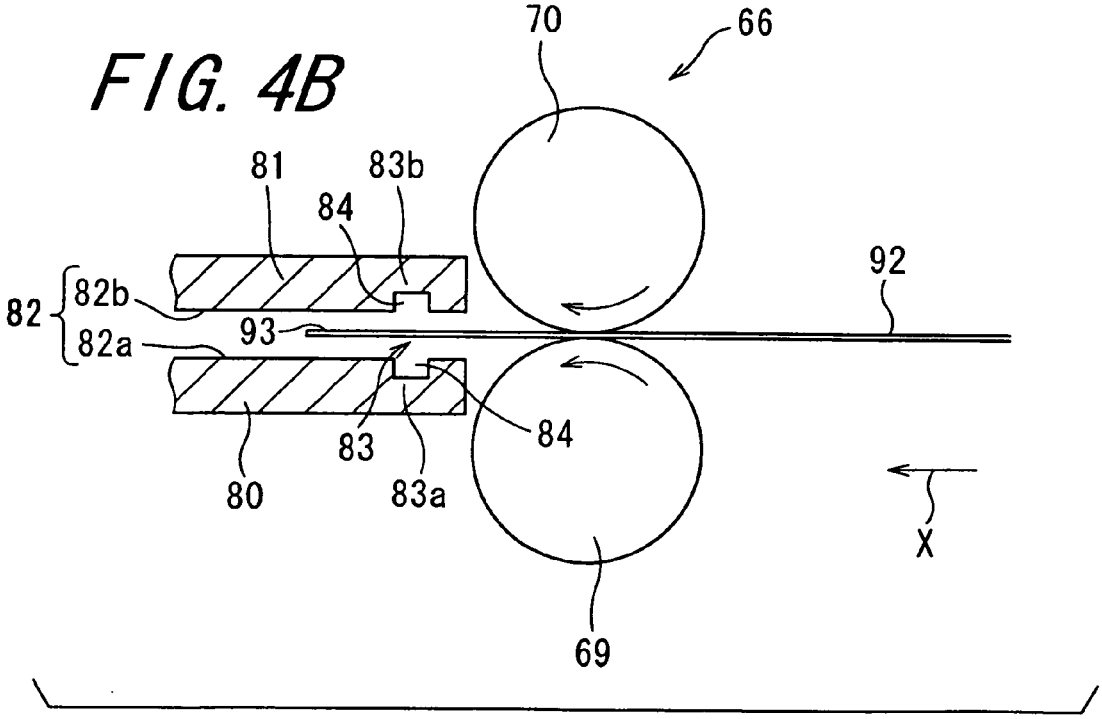

FIGS. 4A and 4B are cross section views showing a state in which a flat sheet 92 that is flat overall is conveyed. FIG. 4A shows a state in which a leading end 93 of the flat sheet 92 has not reached the blocking portion 83, and FIG. 4B shows a state in which the leading end 93 of the flat sheet 92 has passed by the blocking portion 83.

In conveyance of a sheet, the pair of delivery rollers 66 nip the one flat sheet 92 guided by the take-out roller 65. By normal rotation of the separating roller 69 and the paper-feeding roller 70 in this state, the nipped flat sheet 92 is conveyed in the sheet conveying direction X. As shown in FIG. 4A, the leading end 93 of the flat sheet 92 stretches along the sheet conveying direction X.

When the flat sheet 92 is conveyed in the sheet conveying direction X in this state, the leading end 93 of the flat sheet 92 comes in contact with one of the two guiding members 80, 81 on the downstream side of the blocking portion 83 in the sheet conveying direction X due to the deformation of the sheet caused by its own weight, and the leading end 93 of the deformed flat sheet 92 is guided. Consequently, as shown in FIG. 4B, the leading end 93 of the flat sheet 92 moves to the downstream side of the blocking portion 83 in the sheet conveying direction without being caught in the concavity 84 formed by the blocking portion 83. That is to say, the flat sheet 92 is conveyed without being obstructed at the blocking portion 83.

As shown in FIGS. 3A to 4B, the blocking portion 83 prevents conveyance of the sheet 91 having the bent leading end, and allows conveyance of the flat sheet 92. As the sheet 91 having the bent leading end, a sheet having something unusual such as a warp, a burr, a flap, a crease or the like at the tip thereof is assumed. The sheet 91 having the bent leading end is very likely to jam in the image forming station 76 when being conveyed to the image forming station 76. In the present embodiment, by making the sheet 91 having bent leading end obstructed at the blocking portion 83 before the sheet 91 having the bent leading end reaches the image forming station 76, it is possible to prevent paper obstruction in the image forming station 76. Consequently, it is possible to prevent deterioration of the image forming station 76, and prolong the life of the image forming station 76. Moreover, by preventing a jam in the image forming station 76, it is possible to prevent a piece of a sheet generated at the time of a jam from being obstructed in the image forming station 76, and it is possible to prevent deterioration of the quality of an image formed on a sheet.

Further, since a plurality of components are densely positioned in the image forming station 76, it is difficult to perform an operation of solving a jam when a sheet is obstructed in the image forming station 76. In the present embodiment, however, by preventing a jam in the image forming station 76 and causing a jam in the conveying path up to the image forming station, it is possible to facilitate an operation of solving a jam.

Referring to FIG. 1 again, a description will be made in detail. The PS rollers 68 convey the sheet 61 at an equal speed to a process speed at which the image forming station 76 forms an image on a sheet. In concrete, in the case of an electrophotographic image forming apparatus, the PS rollers rotate at an equal peripheral velocity to a peripheral velocity of a photoreceptor drum. Moreover, the PS rollers 68 start conveyance of the sheet in synchronization with the image forming station 76, in a state in which the PS rollers stand by while nipping the sheet therebetween, whereby it is possible to form an image on the sheet without displacements.

Figure 5:
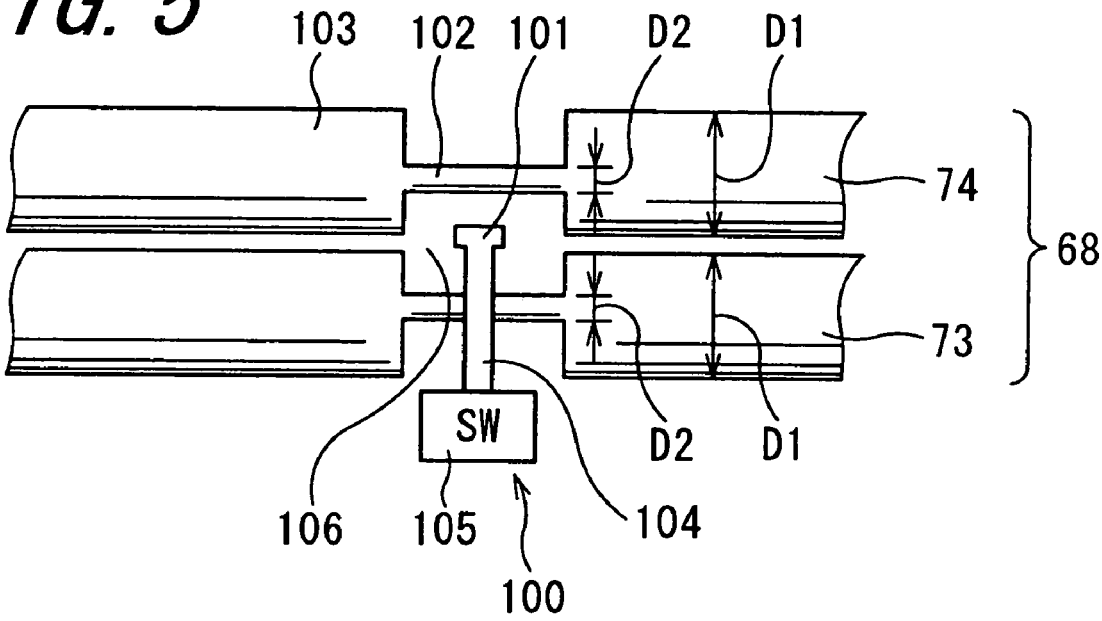
FIG. 5 is a front view showing the pair of PS rollers.

FIG. 5 is a front view showing the pair of PS rollers 68. To the pair of PS rollers 68, a sheet sensor 100 determining whether a sheet is nipped therebetween is disposed. The sheet sensor 100 functions as a jam detecting sensor. The first PS roller 73 and the second PS roller 74 are formed into the same shape, and formed so that outer diameters D2 of central portions 102 in the axial directions are smaller than outer diameters D1 of the remaining portions 103. Consequently, between the central portions 102 in the axial directions, a sheet passing space 106 through which a conveyed sheet passes is formed.

Figure 6A:
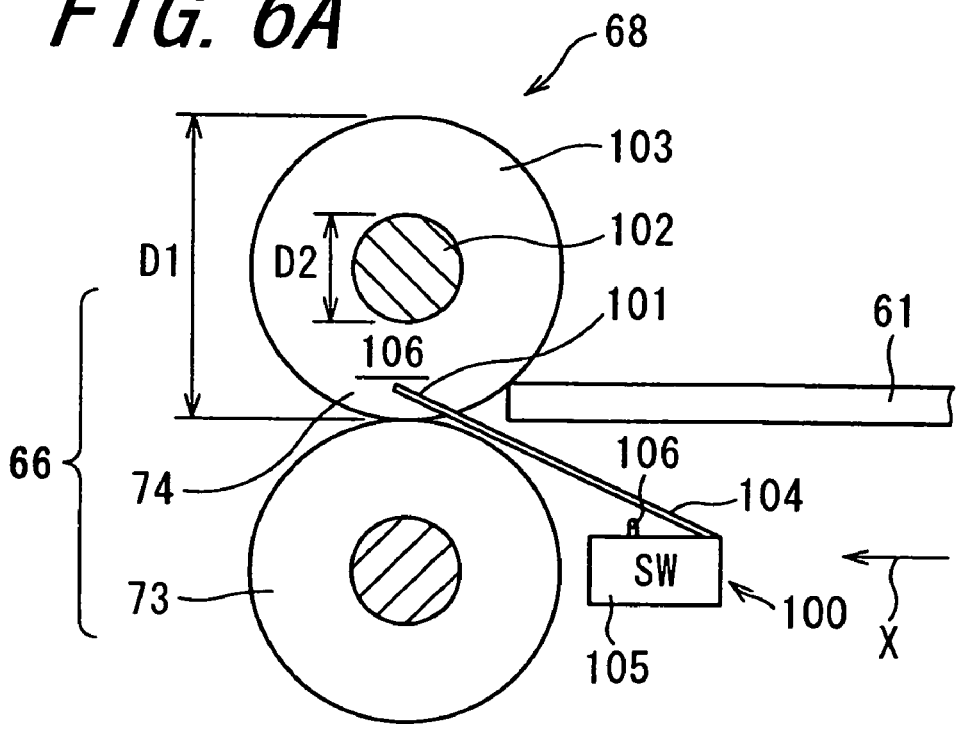
FIGS. 6A and 6B are cross section views showing a sheet conveyed to the pair of PS rollers.
Figure 6B:
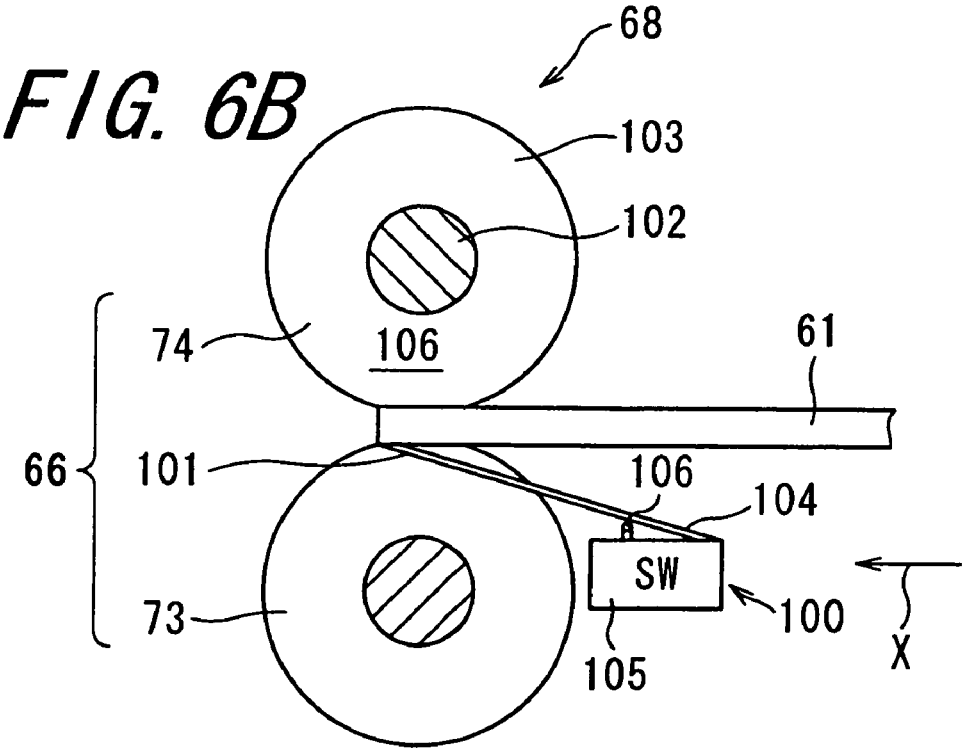

FIGS. 6A and 6B are cross section views showing a sheet conveyed to the pair of PS rollers 68. FIG. 6A shows a state in which the pair of PS rollers 68 have not nipped the sheet, and FIG. 6B shows a state in which the pair of PS rollers 68 have nipped the sheet. As shown in FIG. 6A, the sheet sensor 100 includes a sheet contact portion 101, a lever 104 that supports the sheet contact portion 101, and a signal outputting portion 105 joined to the lever 104. The lever 104 is elastic and flexible, and formed so as to be capable of shifting. The signal outputting portion 105 detects a shift of the lever when the lever 104 having shifted comes in contact with a switch portion 106. The sheet sensor 100 is realized by, for example, a limit switch.

The sheet contact portion 101 is positioned in the sheet passing space 106. As shown in FIG. 6B, when the sheet is nipped between the pair of PS rollers 68, the sheet 61 abuts against the sheet contact portion 101, and the lever 104 supporting the sheet contact portion 101 shifts. The signal outputting portion 105 outputs that the sheet 61 is nipped between the pair of PS rollers 68 by detecting a shift of the lever 104, and gives the controlling means 79 a nipping signal representing that the sheet 61 is nipped.

Figure 7:
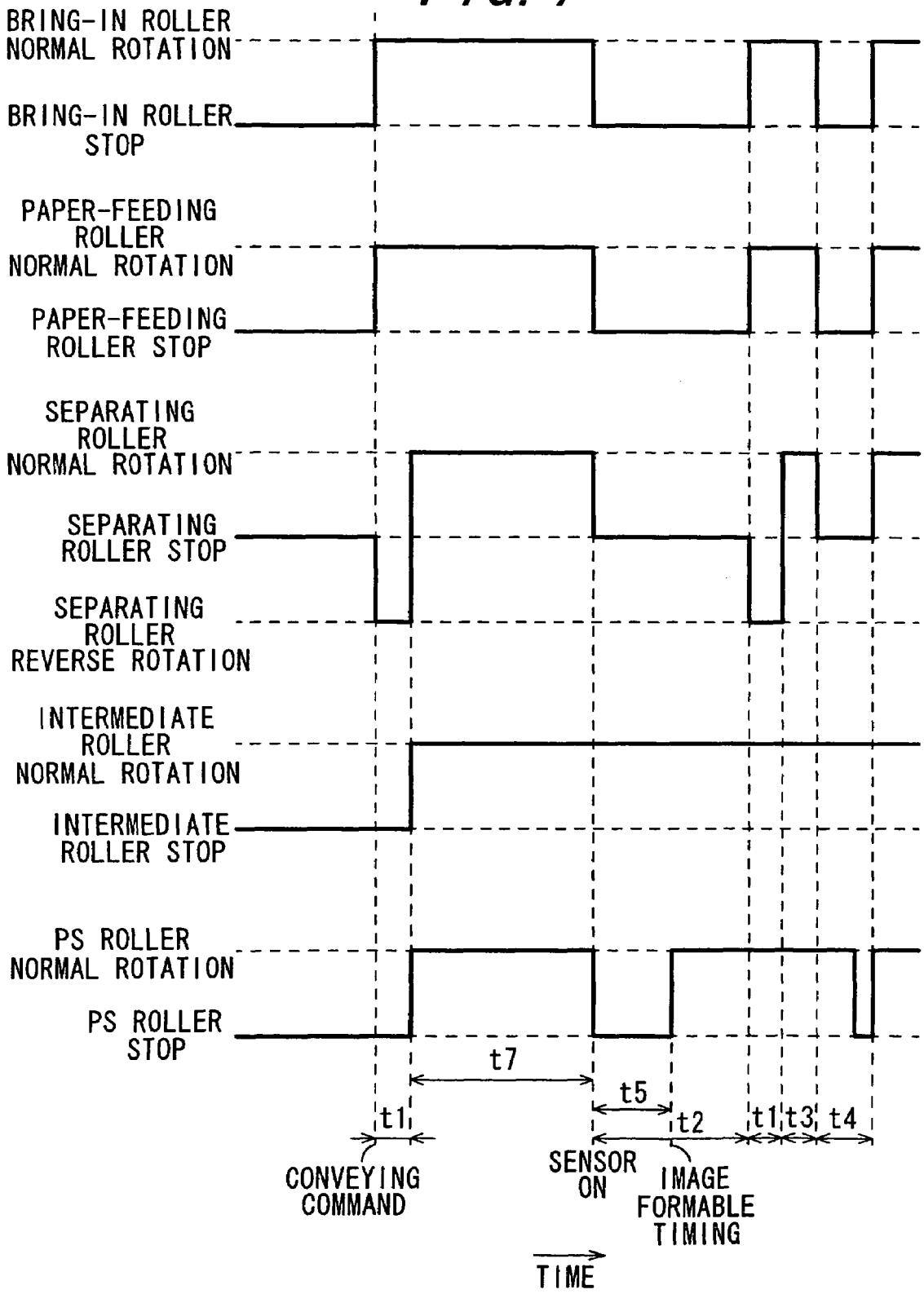
FIG. 7 is a timing chart showing the operations of the respective rollers.

FIG. 7 is a timing chart showing the operations of the respective rollers. The respective rollers are rotated by the motor 78, and the controlling means 79 controls the motor 78. When receiving an image forming direction from the operator or others, the controlling means 79 selectively gives a rotation command to the respective rollers.

Consequently, the take-out roller 65 comes in contact with the sheet 61, and normally rotates. Moreover, the paper-feeding roller 70 normally rotates, and the separating roller 69 reversely rotates. By reverse rotation of the separating roller 69, the remaining sheets except a sheet that is in contact with the paper-feeding roller 69 of one or a plurality of sheets conveyed by the take-out roller 65 are pushed out.

When a conveying command is given to the motor 78 and a first specified time t1 has elapsed, the controlling means 79 causes the separating roller 69 to normally rotate. Consequently, the sheet 61 that is in contact with the paper-feeding roller 70 is nipped between the paper-feeding roller 70 and the separating roller 69, and conveyed toward the pair of intermediate rollers 67.

Further, when the conveying command is given and the first specified time t1 has elapsed, the controlling means 79 causes the intermediate rollers 71, 72 and the PS rollers 73, 74 to normally rotate. Consequently, the sheet 61 is conveyed from the pair of delivery rollers 66 and nipped by the pair of intermediate rollers 67, and then, conveyed toward the pair of PS rollers 68 by the pair of intermediate rollers 67.

When the sheet is conveyed toward the pair of PS rollers 68 and the sheet is nipped by the pair of PS rollers 68, a nipping signal representing that the pair of PS rollers 68 are nipping the sheet is given to the controlling means 79. When receiving the nipping signal from the sheet sensor 100, the controlling means 79 stops rotation of the respective rollers 73, 74 forming the pair of PS rollers 68. Then, the controlling means synchronizes with the image forming station 76, and when it becomes a timing t5 at which it is possible to form an image on a sheet, the controlling means causes the pair of PS rollers 68 to normally rotate to convey the sheet 61 toward the image forming station 76.

In a case where the sheet does not jam, when a predetermined time t7 expires after normal rotation of the separating roller 69 is started, the sheet sensor 100 turns on and outputs a nipping signal. In other words, in a case where the sheet sensor 100 is not on when the predetermined time t7 expires after normal rotation of the separating roller 69 is started, the controlling means 79 determines that the sheet has jammed.

The respective rollers 73, 74 forming the pair of PS rollers 68 rotate at the same speed as a process speed V1 in the image forming station 76. On the other hand, in conveyance of a sheet, the respective rollers 69, 70, 71, 72 forming the pair of intermediate rollers 67 and the pair of delivery rollers 66 and the take-out roller 65 rotate at a speed V2 higher than the process speed V1. For example, the pair of intermediate rollers 67, the pair of delivery rollers 66 and the take-out roller 65 rotate at a speed 1.2 times or more and 1.5 times or less the process speed. Consequently, even if a conveyed sheet is moving on the skew, the skew movement is solved while the sheet is nipped by the pair of PS rollers 68.

In a case where images are successively formed on the respective sheets, in order to quicken a paper-feeding timing, a second sheet is nipped between the paper-feeding roller 70 and the separating roller 69 before image formation on a first sheet finishes. In this case, when a nipping signal of the first sheet is given from the sheet sensor 100 and a second specified time t2 has elapsed, the controlling means 79 causes the take-out roller 65 and the paper-feeding roller 70 to normally rotate, and causes the separating roller 69 to reversely rotate. Herein, the second specified time t2 is a time shorter than a period of time from the supply of the nipping signal to the finish of image formation on the first sheet.

Then, the remaining sheets except one sheet that is in contact with the paper-feeding roller of one or a plurality of sheets conveyed by the take-out roller 65 are pushed back. When the second specified time t2 has elapsed and another first specified time t1 further has elapsed, the controlling means causes the separating roller 69 to normally rotate. Consequently, the one sheet 61 that is in contact with the paper-feeding roller 70 is nipped between the paper-feeding roller 70 and the separating roller 69, and conveyed toward the pair of intermediate rollers 67. When the first specified time t1 has elapsed and a third specified time t3 has elapsed, rotation of the take-out roller 65, the paper-feeding roller 70 and the separating roller 69 is stopped. Consequently, the second sheet 61 is brought into a state in which the sheet protrudes a predetermined take-out amount from the pair of delivery roller 66. The controlling means 79 causes the pair of delivery rollers 66 to stand by in a state in which the second sheet protrudes therefrom, and when determining that the first sheet has left the pair of PS roller 68, the controlling means causes the rollers to convey the second sheet to a nipping position of the pair of PS rollers 68 at a fourth specified timing t4. By thus successively forming images on sheets, it is possible to convey sheets at a high speed.

Figure 8:
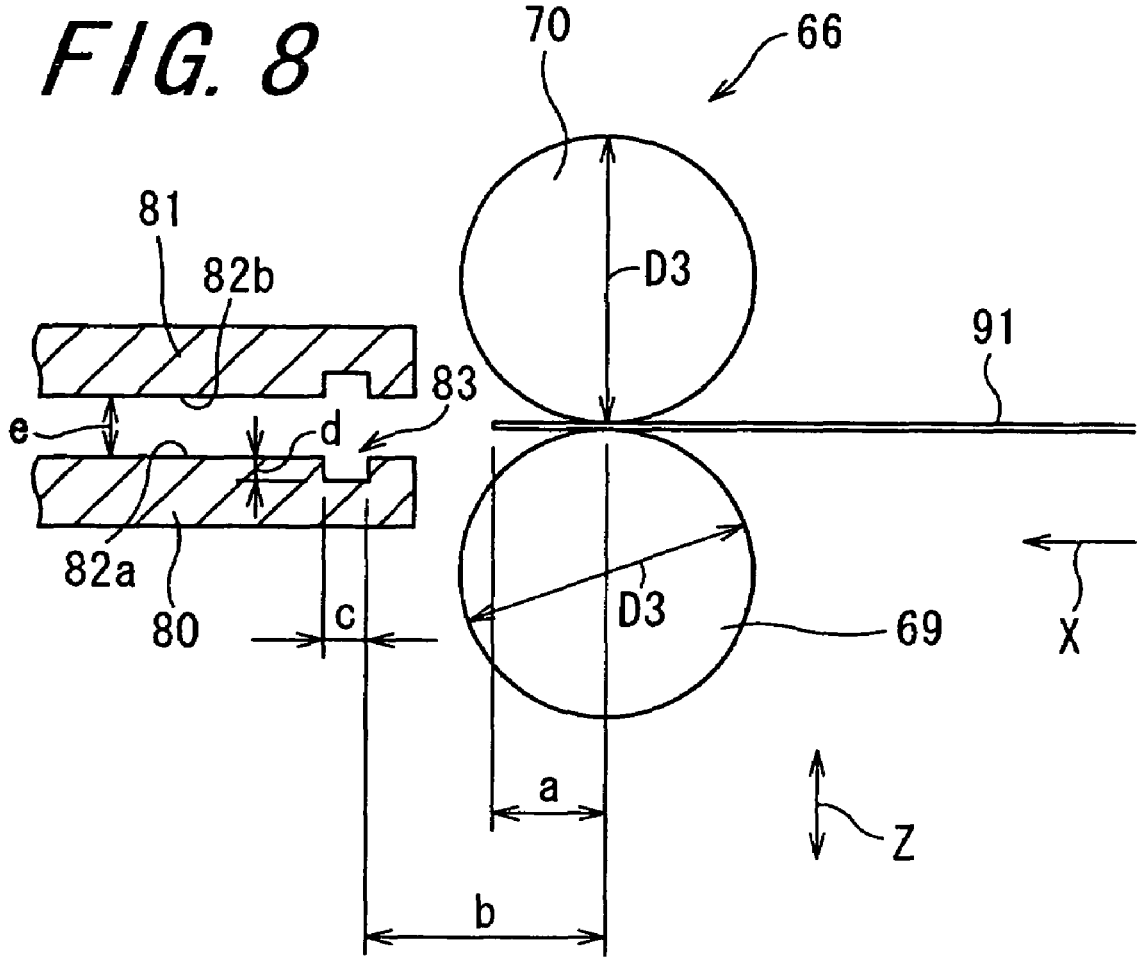
FIG. 8 is a cross section view showing a stand-by state in which the second sheet is protruded by a predetermined take-out amount "a"

FIG. 8 is a cross section view showing a stand-by state in which the second sheet 61 is protruded by a predetermined take-out amount "a". In the present embodiment, diameters D3 of the paper-feeding roller 70 and the separating roller 69 are set to 26 mm, and a distance "e" between the first sheet guiding surface 82*a* and the second sheet guiding surface 82*b* is set to 3 mm. Moreover, in the present embodiment, the take-out amount "a" relating to successive image formation is set to 3 mm or more and 5 mm or less.

As a formation distance "b" of the blocking portion 83, an optimum distance is determined by the take-out amount "a". The inventors conducted an experiment on the relation between the take-out amount "a" and the formation distance "b" of the blocking portion 83. Table 1 shows the result of the experiment. The formation distance "b" of the blocking portion 83 means a distance "b" from a nipping position in which a sheet is nipped by the paper-feeding roller 70 and the separating roller 69 to a position in which the blocking portion 83 is formed, more precisely, represents a distance between the surface on the upstream side of the blocking portion 83 in the sheet conveying direction and the nipping position of the pair of delivery rollers 66.

TABLE 1

| | Value obtained by dividing distance "b" of blocking portion 83 by take-out amount "a" (b/a) | | | | | |
|---|---|---|---|---|---|---|
| | 1 | 2 | 3 | 4 | 5 | 6 |
| Thin paper | All | All | All | All | All | Some |
| Normal paper | Some | All | All | All | All | All |
| Thick paper | None | Some | All | All | All | All |

Table 1 shows the presence of the sheets 91 having the bent leading ends, which were thin paper normal paper and thick paper, in a case where the take-out amount "a" and the distance "b" of the blocking portion 83 were changed. In Table 1, "All" refers to that the sheets 91 having bent leading ends jammed at the blocking portion 83. "Some" refers to that some of the sheets 91 having bent leading ends passed by without jamming at the blocking portion 83. "None" refers to that the sheets 91 having bent leading ends passed by without jamming at the blocking portion 83. An environmental test was conducted, in which temperature and humidity were changed. As shown in the result of the experiment, it appears that, by setting the distance "b" of the blocking portion 83 to three times or more and five times or less the take-out amount "a", it is possible to securely block the sheet 91 having the bent leading end at the blocking portion 83 regardless of the thickness of the sheet having the bent leading end.

Figure 9:
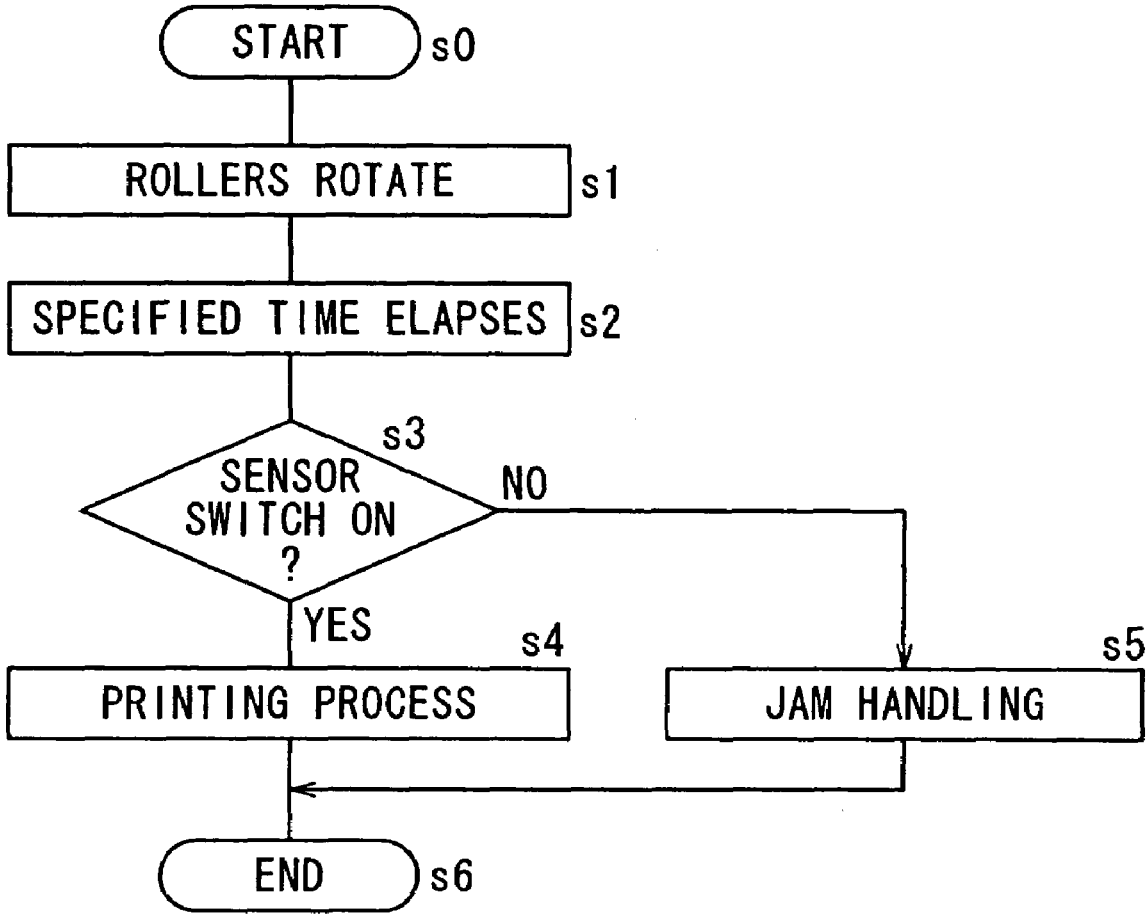
FIG. 9 is a flowchart showing an operation of conveying a sheet by the controlling means.

FIG. 9 is a flowchart showing an operation of conveying a sheet by the controlling means 79. When the controlling means 79 receives an image forming direction from the operator or others at step s0, the procedure goes to step s1, and the controlling means starts the operation of conveying a sheet. At step s1, the controlling means causes the respective rollers to rotate as mentioned before to convey the manually fed sheet 61 stored in the manual-bypass tray 54 toward the image forming station 76.

At step s2, the controlling means counts an elapsed time, and when conveyance of the sheet is started and the time t7 in which the sheet may be nipped by the pair of PS rollers 68 has elapsed, the procedure goes to step s3. At step s3, the controlling means determines whether or not a nipping signal is given from the sheet sensor 100, and in a case where a nipping signal is given, the procedure goes to step s4. At step s4, a usual image forming process is performed, and the procedure goes to step s6, and the conveyance operation is ended at step s6.

In a case where a nipping signal is not given from the sheet sensor 100 at step s3, the procedure goes to step s5. At step s5, predetermined jam handling is performed. That is to say, in a case where the sheet does not reach the pair of PS rollers 68 before the specified time t7 has elapsed, the controlling means determines that the sheet has jammed. At step s5, the controlling means stops rotation of the respective rollers, and stops an image forming operation in the image forming station 76. For example, in a case where the image forming apparatus 30 employs the electrophotographic system, the controlling means stops development onto a photoreceptor drum, and stops application of a fixing voltage. After the jam handling is thus performed, the procedure goes to step s6, and the conveyance operation is ended at step s6.

From the foregoing, according to the present embodiment, the sheet 91 having the bent leading end is prevented from moving by the blocking portion 83 placed on the upstream side of the image forming station 76 in the sheet conveying direction. Then, the sheet 91 having the bent leading end jams before reaching the image forming station 76. Consequently, it is possible to prevent the sheet 91 having the bent leading end from being obstructed in the image forming station 76 when the sheet 91 having the bent leading end that is very likely to jam is manually fed.

By preventing a jam in the image forming station 76, it is possible to prevent deterioration of the image forming station 76 resulting from a jam, and it is possible to inhibit shortening of the life of the image forming station 76 resulting from a jam. Moreover, on the contrary, by making the flat sheet 92 pass by the blocking portion, it is possible to form an image on the flat sheet 92.

In the present embodiment, in a case where a manually fed sheet is the sheet 91 having the bent leading end, the blocking portion 83 prevents conveyance of the sheet. It is relatively common that manually fed sheets have burrs, flaps, warps, folds, the marks of staplers or the like at the tips thereof. Moreover, in worse cases, staplers or clips remain on the sheets. Furthermore, the sheets are of various materials and shapes. Therefore, manually fed sheets are very likely to jam. By thus preventing movement of the sheet 91 having the bent leading end among manually fed sheets in which the sheets 91 having bent leading ends and the flat sheets 92 are easily mixed, it is possible to effectively inhibit a jam in the image forming station 76.

Further, components are densely disposed in the image forming station 76, and when a jam occurs in the image forming station 76, it takes time and effort to solve the jam. On the contrary, in the present embodiment, by causing a jam in the conveying path on the upstream side of the image forming station 76 in the sheet conveying direction, it is possible to save time and effort to solve a jam. Moreover, by preventing a jam in the image forming station 76, it is possible to easily carry out maintenance of the image forming station 76. Furthermore, the components of the image forming station 76 are usually more expensive than components for conveyance disposed on the upstream side in the sheet conveying direction of the image forming station 76 in the sheet conveying direction. Therefore, in the present embodiment, even if components are damaged by a jam, it is enough to replace the conveying components, so that it is possible to repair the damage due to the jam at a low cost.

Further, in the present embodiment, the blocking portion 83 is formed near the pair of delivery rollers 66 as well as on the downstream side of the pair of delivery rollers 66 in the sheet conveying direction, whereby it is possible to make part of the jammed sheets 91 having bent leading ends remain in the manual-bypass tray 54. Consequently, even if the sheet 91 having the bent leading end jams, it is possible to easily solve the jam by pulling the jammed sheet out of the manual-bypass tray 54 without opening the inner space of the image forming apparatus 30.

Further, when the controlling means 79 determines that a jam has occurred, the controlling means gives a stop command to the image forming station 76 and the motor 78. Consequently, it is possible to prevent the jam from further progressing after the occurrence of the jam is detected, and stop an image forming operation. Consequently, it is possible to easily solve a jam, and it is possible to prevent an unnecessary image forming operation and prevent wasteful use of consumables such as toner. Moreover, by using the sheet sensor 100 determining that a sheet is nipped between the PS rollers 73, 74 as a sensor for detecting a jam, it is possible to decrease the number of sensors, and it is possible to form the image forming apparatus 30 at a low cost.

Further, by making the blocking portion 83 retract from the sheet guiding surface 82, it is possible to catch the bent leading end of the sheet 91 in the concave formed by the blocking portion 83, and it is possible to make the leading end 93 of the flat sheet 92 pass by without making the leading end abut against the blocking portion 83. Therefore, by using the blocking portion 83, it is possible to precisely achieve prevention of movement of the sheet 91 having the bent leading end and allowance of movement of the flat sheet 92.

Further, since the blocking portions 83 are disposed to both the two guiding members 80, 81, it is possible to cause a jam at the blocking portion 83 whichever direction the bent leading end 90 of the sheet 91 is bent in, and it is possible to more securely prevent the sheet 91 having the bent leading end from being conveyed toward the image forming station 76. For example, the condition of a warp of a sheet varies depending on temperature, humidity, the direction of extension of fiber and so on. In the present embodiment, it is possible to securely prevent the possibility of a jam of a sheet in the image forming station 76 even in the above case.

Furthermore, since an angle formed by the surface 87 on the downstream side of the blocking portion 83 in the sheet conveying direction and the sheet guiding surface 82 is set to 90 degrees or less, it is possible to prevent the bent leading end 90 of the sheet 91 caught in the concavity 84 of the blocking portion 83 from escaping from the concavity 84 of the blocking portion 83, and it is possible to more securely prevent the sheet 91 having the bent leading end from moving downstream in the sheet conveying direction from the blocking portion 83.

Further, in the present embodiment, the guiding members 80, 81 are formed so that lengths L2 in an orthogonal direction thereof are larger than a length L1 in an orthogonal direction of a sheet, and the blocking portion 83 extends in an orthogonal direction Y over the conveyed sheet 61 in the orthogonal direction Y. Consequently, even if a bent part of the bent leading end 90 of the sheet 91 is formed at the end in the orthogonal direction Y, the bent part certainly abuts against the blocking portion 83. Therefore, it is possible to more securely prevent the sheet 91 having the bent leading end from moving to the downstream side of the blocking portion 83 in the sheet conveying direction.

Figure 10:
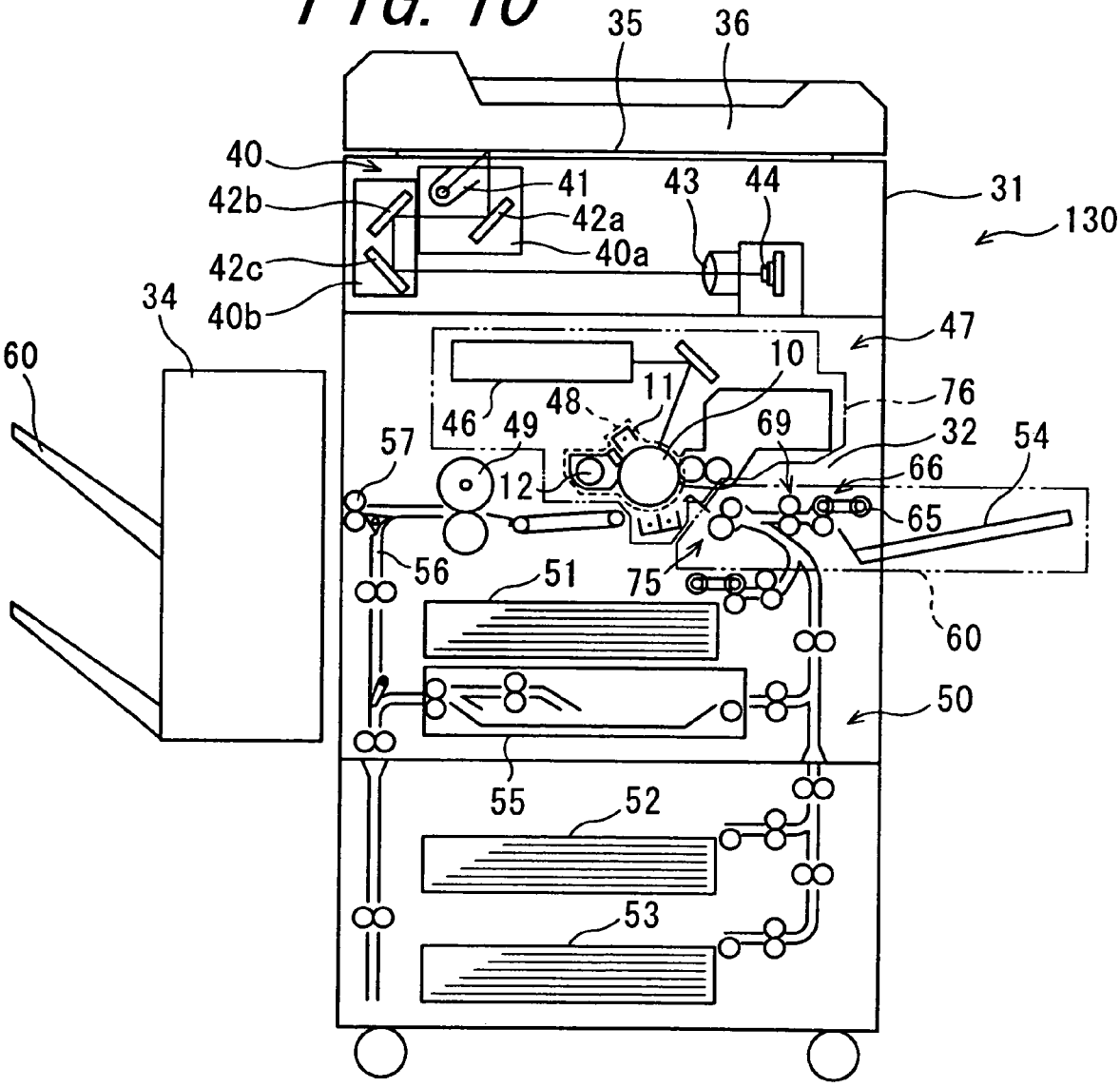
FIG. 10 is a cross section view showing the entire configuration of a digital multifunctional system according to an embodiment of the invention.

FIG. 10 is a cross section view showing the entire configuration of a digital multifunctional system 130 according to an embodiment of the invention. The digital multifunctional system 130 comprises the configuration of the aforementioned image forming apparatus 30. That is to say, the digital multifunctional system comprises the aforementioned manually fed sheet conveying device 60. The manually fed sheet conveying device 60 conveys a sheet manually fed into the manual-bypass tray 54 to the image forming station 76. Herein, the image forming station 76 is constituted by an image forming unit 32 and a laser writing unit 46.

On a platen 35 made of light-transmitting glass of the digital multifunctional system 130, an automatic document feeder 36 is provided. The automatic document feeder 36 is a device that automatically feeds a plurality of documents set on a document set tray onto the platen 35 one by one.

Below the platen 35 is a document reading unit 31 equipped with a scanner 40. The scanner 40 scans and reads an image of a document placed on the platen 35, and is composed of a lamp reflector assembly 41 that exposes a document surface, a CCD image sensor 44 that is a photoelectric transfer element for converting a reflection light image from the document to electric image signals, a first scanning unit 40*a* equipped with a first reflection mirror 42*a* reflecting reflection light from a document, for guiding a reflection light image from a document to a CCD image sensor 44, a second scanning unit 40*b* equipped with second and third reflection mirrors 42*b*, 42*c*, for guiding the reflection light image from the first reflection mirror 42*a* to the CCD image sensor 44, and an optical lens 43 for forming an image on the CCD image sensor 44 for converting the reflection light image from the document to electric image signals via the aforementioned reflection mirrors.

Further, the scanner 40 reads an image of a document automatically conveyed by the automatic document feeder 36 at a specified exposure position in an operation associated with the automatic document feeder 36.

A document image read by the scanner 40 is sent as image data to a not-shown image data inputting portion of an image forming portion 47. Then, after specified image processing to the image data is performed, the image-processed image data is temporarily stored into a memory of an image processing portion, and the image data in the memory is read out in response to an output direction, and transferred to a laser writing unit 46.

The image forming portion 47 is composed of an image forming unit 32, the laser writing unit 46, and a paper feeding portion 50. The laser writing unit 46 has a semiconductor laser light source that emits a laser beam in response to image data read out of the memory or image data transferred from an external apparatus, a polygon mirror that deflects a laser beam at an equiangular velocity, an f-θ lens that corrects so that a laser beam deflected at an equiangular velocity is deflected at an equiangular velocity on a photoreceptor drum 10 constituting the image forming unit 32, and so on.

The image forming unit 32 is equipped with, around the well-known photoreceptor drum 10, a charging device 11 for charging the photoreceptor drum 10 to a specified potential, a developing device for supplying toner to an electrostatic latent image formed on the photoreceptor drum 10 and makes the image visible, a transfer device for transferring a toner image formed on the surface of the photoreceptor drum 10 to recording paper, a cleaning device 12 for collecting extra toner, and a charge eliminating device. Furthermore, the photoreceptor drum 10, the charging device 11 and the cleaning device 12 of the image forming unit 32 are formed in one piece, which is a unit structure that can be attached to and detached from the image forming portion as a replacement unit 48.

A document image read by the scanner 40 is once stored in the image memory, and thereafter, read out. Subsequently, by scanning with a laser beam from the laser writing unit 46, an electrostatic latent image is formed on the surface of the photoreceptor drum 10 and made to be visible by toner in the developing device, and becomes a toner image. The toner image is electrostatically transferred onto a supplied recording sheet by the transfer device, and thereafter, the sheet is sent to the fixing unit 49.

On the discharge side of the image forming unit 32, not only the fixing unit 49, but also a switchback path 56 for reversing the back and front of recording paper in order to form an image again on the reverse side of the recording paper, and a post-processing device 34 for performing stapling or the like to recording paper on which an image is formed and having an elevating tray 60 are provided. Recording paper on which a toner image has been fixed by the fixing unit 49 is guided to the post-processing device 34 by a paper-discharging roller 57 via the switchback path 56 as necessary, and discharged after being subjected to specified post-processing here.

The paper-feeding portion 50 is placed below the image forming unit 32, and has the manual-bypass tray 54, a double-side unit 55, a multistage paper-feeding tray portion that has sheet cassettes 51, 52, 53, and conveying means for conveying sheets fed from the cassettes 51, 52, 53 and the tray 54 to a transfer position in which the transfer device is positioned in the image forming unit 32. The double-side unit 55 communicates with the switchback path 56 that reverses recording paper, and is used at the time of forming images on both the sides of recording paper.

The sheet conveying device 60 of the present embodiment can be used in not only the digital multifunctional system 130 but also another image forming apparatus, for example, a general sheet processing apparatus to which paper can be manually fed, such as a laser printer, an ink jet printer or a thermal head printer.

Figure 11:
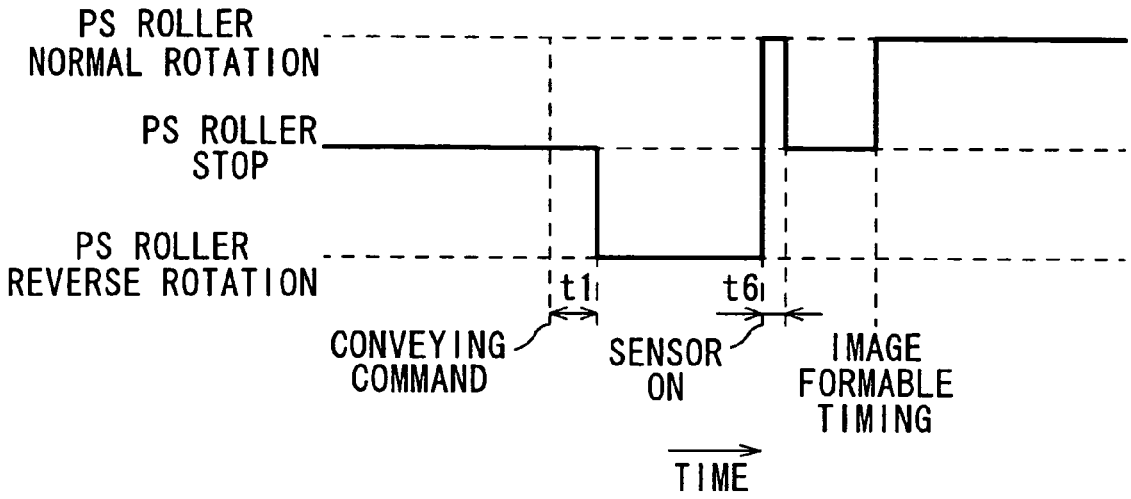
FIG. 11 is a timing chart showing another operation of the PS rollers.

FIG. 11 is a timing chart showing another operation of the PS rollers. In this case, when a conveying command is given to the motor 78 and the first specified time t1 has elapsed, the PS rollers 73, 74 are reversely rotated, and a sheet is conveyed toward the pair of PS rollers 68, and when the sheet is nipped by the PS rollers 68, the sheet sensor 100 gives a nipping signal to the controlling means 79. When receiving a nipping signal from the sheet sensor 100, the controlling means 79 causes the pair of PS rollers 68 to normally rotate until a fifth specified time t8 has elapsed, and stops rotation of the respective rollers 73, 74 composing the pair. Then, the controlling means synchronizes with the image forming station 76, and when it becomes a timing at which it is possible to form an image on the sheet, the controlling means causes the pair of PS rollers 68 to normally rotate to convey the sheet 61 toward the image forming station 76. By thus causing the PS rollers to reversely rotate, it is possible to more securely prevent a skew movement of the sheet.

Figure 12:
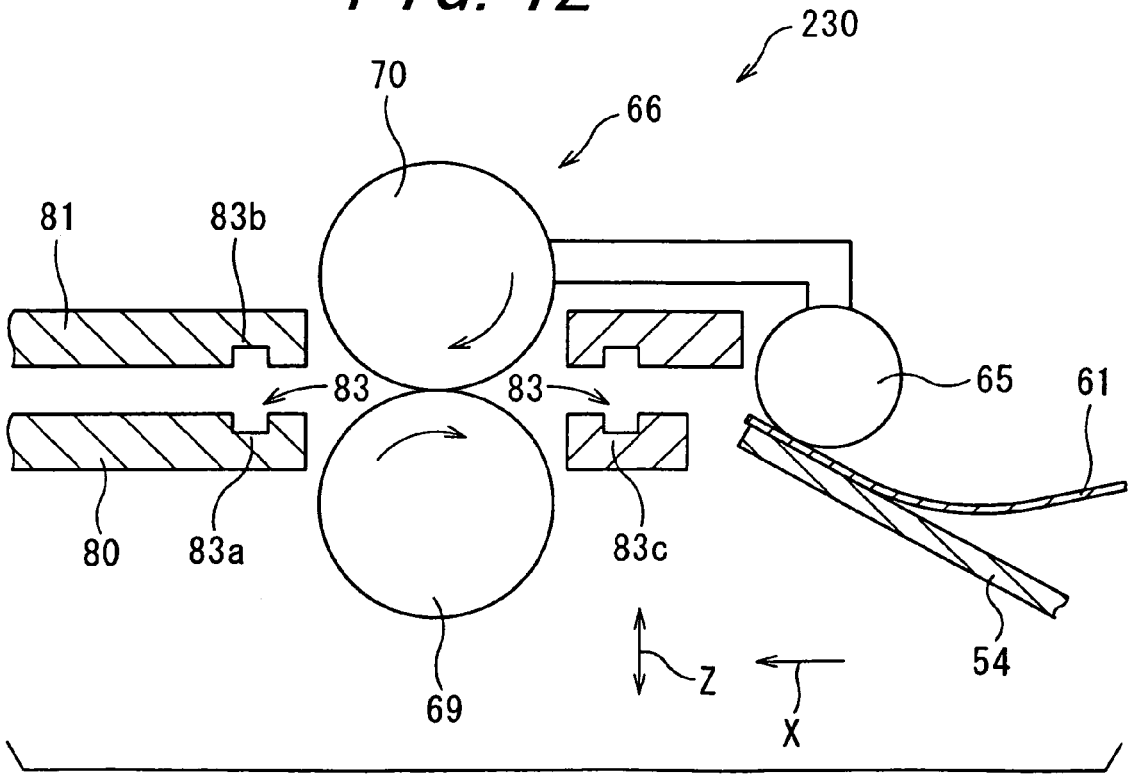
FIG. 12 is a view showing part of an image forming apparatus according to a second embodiment of the invention.

FIG. 12 is a view showing part of an image forming apparatus 230 according to a second embodiment of the invention. Since the image forming apparatus 230 of the second embodiment has a configuration similar to that of the image forming apparatus 30 of the first embodiment, the same components will be denoted by the same reference numerals, and the description thereof will be omitted. Although the blocking portion 83 is disposed on the downstream side of the pair of delivery rollers 66 in the sheet conveying direction in the first embodiment, the blocking portion may be disposed on the downstream side of the take-out roller 65 in the sheet conveying direction.

In the image forming apparatus 230 of the second embodiment shown in FIG. 12, the blocking portions 83 are positioned on the upstream side in the sheet conveying direction and on the downstream side of the pair of delivery rollers 66 in the sheet conveying direction. Consequently, in a case where the sheet 61 taken out of the take-out roller 65 is the sheet 91 having the bent leading end, the sheet is prevented from moving in the sheet conveying direction X by a blocking portion 83*c* positioned on the upstream side of the pair of delivery rollers 66 in the sheet conveying direction 66 before reaching the pair of delivery rollers 66. Consequently, it is possible to more securely prevent a jam of the sheet having the bent leading end. The shape of the blocking portion 83*c* on the upstream side of the pair of delivery rollers 66 in the sheet conveying direction is the same as the shapes of the blocking portions 83*a*, 83*b* on the downstream side of the pair of delivery rollers 66 in the sheet conveying direction.

Further, since the bent leading end 90 of the sheet 91 abuts against the blocking portion 83*c* on the upstream side of the pair of delivery rollers 66 in the sheet conveying direction, it is possible to make a larger part of the sheet remain in the manual-bypass tray 54 when a jam occurs, and it is possible to more easily solve the jam.

Although the blocking portions 83*a*, 83*b* are also disposed on the downstream side of the pair of delivery rollers 66 in the sheet conveying direction in the second embodiment shown in FIG. 12, it is possible to achieve the object of the invention by disposing the blocking portion 83*c* on the downstream side of the take-out roller 65 in the sheet conveying direction even if the blocking portions 83*a*, 83*b* are not disposed on the downstream side of the pair of delivery rollers 66 in the sheet conveying direction. That is to say, there is no problem as far as the blocking portion 83 is disposed on the downstream side of a roller in the sheet conveying direction which roller is on the upstream side of the PS rollers 73, 74 in the sheet conveying direction and the blocking portion may be disposed on the downstream side of the intermediate rollers 71, 72 in the sheet conveying direction.

Figure 13:
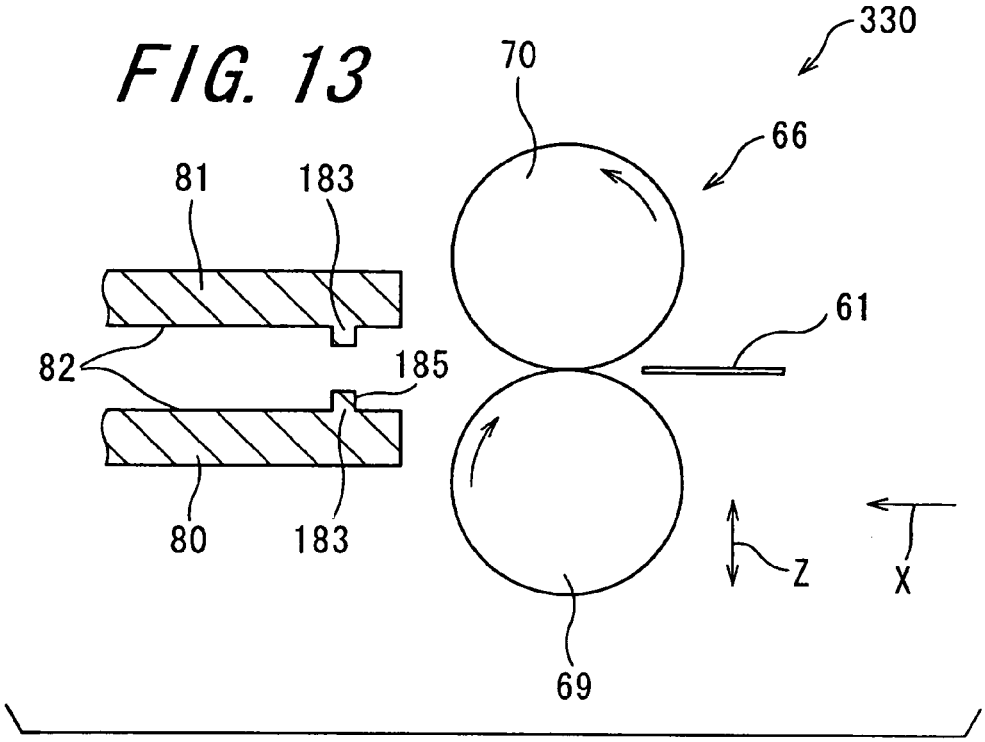
FIG. 13 is a view showing part of an image forming apparatus according to a third embodiment of the invention.

FIG. 13 is a view showing part of an image forming apparatus 330 according to a third embodiment of the invention. Since the image forming apparatus 330 of the third embodiment has a configuration similar to that of the image forming apparatus 30 of the first embodiment, the same components will be denoted by the same reference numerals, and the description thereof will be omitted. Although the blocking portions 83*a*, 83*b* are concave portions formed by retracting from the guiding members 80, 81 in the first embodiment, a blocking portion 183 is formed into a convex shape protruding in the thickness direction Z from the sheet guiding surface 82 in the third embodiment shown in FIG. 13. The blocking portion 183 extends in the orthogonal direction Y, and faces the conveying path. The blocking portion 183 is formed so that an angle formed by a surface 185 on the upstream side in the sheet conveying direction and the sheet guiding surface 82 is 90 degrees or less, in the present embodiment, 90 degrees.

In a case where the blocking portion 183 is formed into a convex shape in this way, the bent leading end 90 of the sheet 91 abuts against the surface 185 on the upstream side of the blocking portion 183 in the sheet conveying direction when the sheet moves along the sheet guiding surface 82. In this case, by setting an angle formed by the surface on the upstream side of the blocking portion 183 in the sheet conveying direction and the sheet guiding surface 82 to 90 degrees or less, it is possible to prevent the bent leading end 90 of the sheet 91 from climbing over the blocking portion 183, and it is possible to prevent the sheet 91 having the bent leading end from moving in the sheet conveying direction X from the blocking portion 183. Also in a case where the blocking portion 183 is formed into a convex shape in this way, it is possible to obtain the same effect as the effect of the first embodiment.

Figure 14:
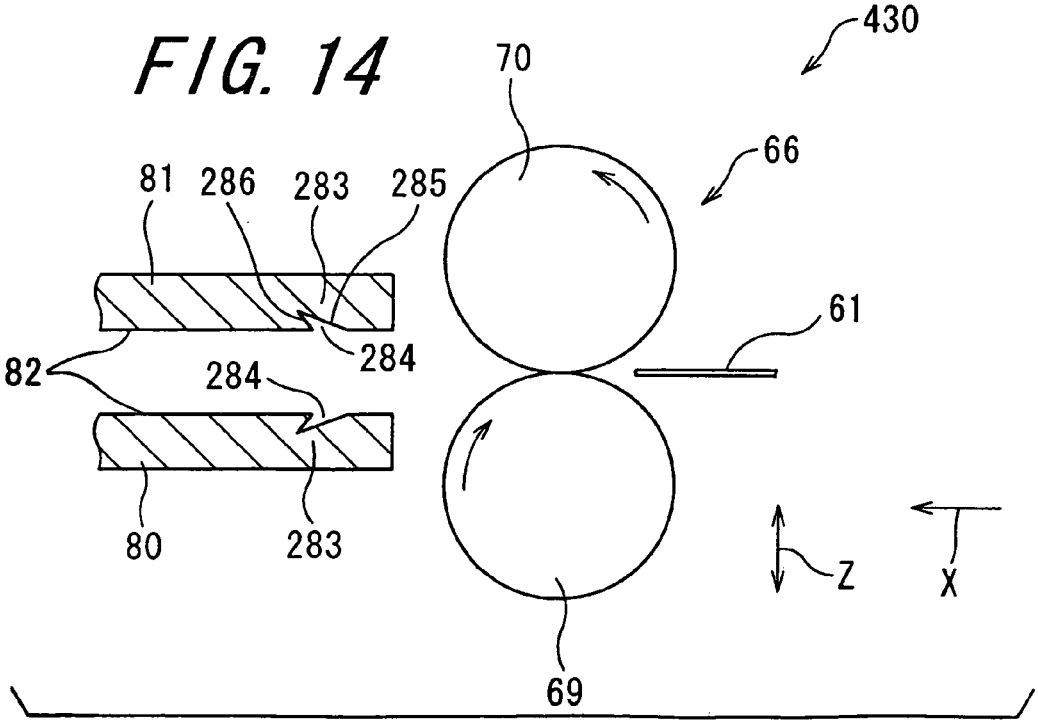
FIG. 14 is a view showing part of an image forming apparatus according to a forth embodiment of the invention.

FIG. 14 is a view showing part of an image forming apparatus 430 according to a forth embodiment of the invention. Since the image forming apparatus 430 of the forth embodiment has a configuration similar to that of the image forming apparatus 30 of the first embodiment, the same components will be denoted by the same reference numerals, and the description thereof will be omitted. Although the blocking portion 83 is formed into a concave shape in the first embodiment and the blocking portion 183 is formed into a convex shape in the third embodiment, a blocking portion may be formed into an arbitrary shape.

In the fourth embodiment shown in FIG. 14, the image forming apparatus 430 has a concavity whose cross section is formed into a triangular shape formed by a blocking portion 283. The blocking portion 283 extends in the orthogonal direction Y, and has two concavity forming surfaces 285, 286, which face the concavity 284. In the case of filling the concavity 284 of the blocking portion 283 with a filling material, the shape of the filling material is formed into a triangular pole shape extending in the width direction Y.

In concrete, the blocking portion 283 has the first concavity forming surface 285 that is connected to the sheet guiding surface 82 and extends in one thickness direction Z1 retracting from the sheet guiding surface 82 with respect to the thickness direction Z from the sheet guiding surface 82, and the second concavity forming surface 286 that extends in the other thickness direction Z2 from the edge in the one thickness direction Z1 of the first concavity forming surface 285 and is connected to the sheet guiding surface 82.

The sheet guiding surface 82 and the first concavity forming surface 285 are formed so that an angle formed thereby is 90 degrees or more. Moreover, the first concavity forming surface 285 and the second concavity forming surface 286 are formed so that an angle formed thereby is 90 degrees or less. Furthermore, the second concavity forming surface 286 and the sheet guiding surface 82 are formed so that an angle formed thereby is 90 degrees or less. By thus forming the blocking portion 283, it is possible to prevent the bent leading end 90 of the sheet 91 fitting into the concavity 284 formed by the blocking portion 283 from escaping from the concavity 284. Besides, also in a case where the blocking portion 283 is formed into an arbitrary shape, it is possible to obtain the same effect as the effect of the first embodiment.

Figure 15:
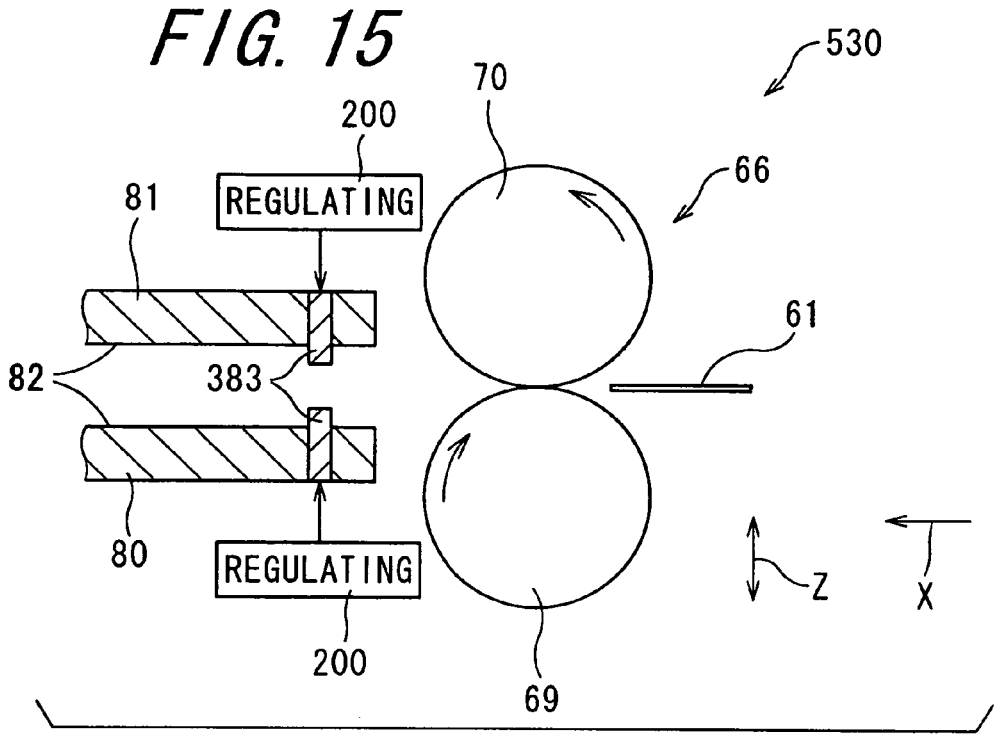
FIG. 15 is a view showing part of an image forming apparatus according to a fifth embodiment of the invention.

FIG. 15 is a view showing part of an image forming apparatus 530 according to a fifth embodiment of the invention. Since the image forming apparatus 530 of the fifth embodiment has a configuration similar to that of the image forming apparatus 30 of the first embodiment, the same components will be denoted by the same reference numerals, and the description thereof will be omitted.

In the fifth embodiment shown in FIG. 15, a blocking portion 383 is disposed so as to be capable of shifting in the thickness direction Z with respect to the sheet guiding surface 82, and adjusting means 200 that makes it possible to adjust a protruding amount or a retracting amount of the blocking portion 383 by driving the blocking portion 383 so as to shift is provided. The adjusting means 200 may be operated manually, or may be operated automatically by driving means such as an actuator.

By adjusting a protruding amount or retracting amount of the blocking portion 383 by the adjusting means 200, it is possible to increase convenience. For example, some operators may use sheets having bent leading ends that are bent in an almost constant condition. In this case, by adjusting the protruding amount or retracting amount of the blocking portion 383 so as to meet the sheet 91 having the bent leading end, it is possible to favorably prevent movement of the sheet 91 having the bent leading end. For example, by making it possible to switch the retracting amount or protruding amount of the blocking portion 383 by three stages among thin paper, normal paper and thick paper, it is possible to more securely prevent movement of the sheet 91 having the bent leading end. Moreover, the blocking portion may be formed so as to be capable of successively shifting to finely adjust the position of the blocking portion 383 depending on the temperature and humidity of the surroundings.

Figure 16:
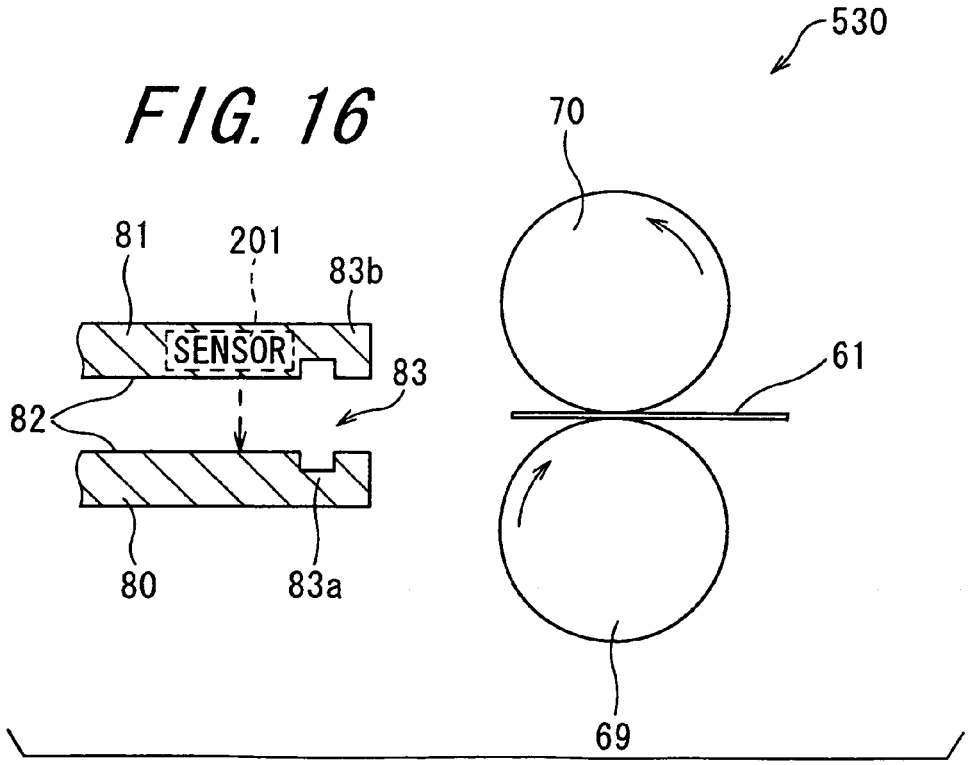
FIG. 16 is a view showing part of an image forming apparatus according to a sixth embodiment of the invention.

FIG. 16 is a view showing part of an image forming apparatus 630 according to a sixth embodiment of the invention. Since the image forming apparatus 630 of the sixth embodiment has a configuration similar to that of the image forming apparatus 30 of the first embodiment, the same components will be denoted by the same reference numerals, and the description thereof will be omitted. Although the sheet sensor 100 that detects a jam is disposed in the vicinity of the PS rollers in the first embodiment, the sheet sensor may be disposed in an arbitrary position.

In the sixth embodiment shown in FIG. 16, a sensor 201 that detects a jam is disposed near the blocking portion 83 on the downstream side of the blocking portion 83 in the sheet conveying direction. The sensor 201 is disposed to the guiding member, and detects whether a conveyed sheet is opposed to the sensor 201 or not. For example, it is possible to realize the sensor by a reflective-type optical sensor.

In a case where a sheet is not opposed to the sensor 201 after a lapse of a time during which the conveyed sheet may be opposed to the sensor 201, the sensor 201 gives the controlling means 79 a jam signal representing that the sheet has jammed. When receiving a jam signal from the sensor 201, the controlling means 79 performs a jam handling operation.

By disposing the sensor 201 near the blocking portion 83, it is possible to determine whether a sheet has jammed in its early stages. Consequently, it is possible to more easily solve a jam, and it is possible to omit an unnecessary operation by the image forming station 76. It is preferred that the sensor 201 is disposed in a position in which part of a sheet remains in the manual-bypass tray while the leading end thereof is opposed to the sensor 201. Consequently, when the rollers are stopped as a jam is detected, a larger part of a sheet remains in the manual-bypass tray, so that it is possible to easily solve the jam.

The respective embodiments as described above are examples of the invention, and the configurations thereof can be changed within the scope of the invention. For example, in the invention, a sheet is not only a sheet made of paper but also a resin sheet such as an OHP (overhead projector) sheet, and used as a synonym with a sheet material. Moreover, the shape of the blocking portion 83, the position of the sensor, the jam handling operation, the rotation operation of the roller and so on described above are examples, and may be changed. Furthermore, a configuration such that the pair of intermediate rollers 67 are disposed is described in the embodiments, but in a case where the distance from the pair of delivery rollers 66 to the pair of PS rollers 68 is short, the pair of intermediate rollers 67 may be omitted. Besides, the sheet conveying devices of the embodiments are favorably used for conveyance of a manually fed sheet, but not limited thereto, and may be used for conveyance of a sheet stored in a tray inside an apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet conveying device comprising:

a pair of rollers for conveying a sheet;

a guider positioned on a downstream side of the pair of rollers in a sheet conveying direction thereof, for guiding the sheet conveyed by the pair of rollers in the sheet conveying direction, the guider having a blocking portion against which, when a sheet having a bent loading end is conveyed, the bent loading end of the sheet abuts and the sheet having a bent loading end is prevented from moving in the sheet conveying direction, and conveying further a sheet in the sheet conveying direction when the sheet not having a bent loading end is conveyed.

2. The sheet conveying device of claim 1, wherein the guider has a sheet guiding surface which faces one surface in a thickness direction of the sheet conveyed by the pair of rollers, and the blocking portion protrudes or retracts from the sheet guiding surface.

3. The sheet conveying device of claim 1, wherein the guider has two sheet guiding surfaces which face both surfaces in the thickness direction of the conveyed sheet, respectively, and the blocking portion protrudes or retracts from each of the sheet guiding surfaces.

4. The sheet conveying device of claim 2, wherein the blocking portion is formed into a concave shape so as to retract from the sheet guiding surface and formed so that an angle formed by a surface on a downstream side of the blocking portion in the sheet conveying direction and the sheet guiding surface is 90 degrees or less.

5. The sheet conveying device of claim 2, wherein the blocking portion is formed into a convex shape so as to protrude from the sheet guiding surface and formed so that an angle formed by a surface on an upstream side of the blocking portion in the sheet conveying direction and the sheet guiding surface is 90 degrees or less.

6. The sheet conveying device of claim 1, wherein the blocking portion is formed so as to have a larger length in an orthogonal direction which intersects the sheet conveying direction at right angles than a length in the orthogonal direction of the conveyed sheet.

7. The sheet conveying device of claim 1, wherein a manually fed sheet is conveyed.

8. The sheet conveying device of claim 1, further comprising:

a controller for controlling the pair of rollers; and a jam detecting sensor for detecting that conveyance of the sheet is prevented by the blocking portion, wherein the controller stops a sheet conveying operation of the pair of rollers when determining that conveyance of the sheet is prevented based on a signal outputted from the jam detecting sensor.

9. An image forming apparatus comprising: conveying means for conveying a sheet in a sheet conveying direction;

guiding means positioned on a downstream side of the conveying means in the sheet conveying direction, for guiding the sheet conveyed by the conveying means; and image forming means positioned on a downstream side of the guiding means in the sheet conveying direction, for forming an image on the sheet, wherein the guiding means has a blocking portion against which, when a sheet having a bent leading end is conveyed, the bent loading end of the sheet abuts and the sheet having a bent loading end is prevented from moving in the sheet conveying direction, and conveying further a sheet in the sheet conveying direction when the sheet not having a bent leading end is conveyed.

10. The image forming apparatus of claim 9, further comprising a manually fed sheet storing portion which is exposed to outside of the apparatus, for storing sheets, wherein the conveying means has a roller for taking out a sheet stored in the manually fed sheet storing portion into the apparatus and driving means for rotating the roller.

11. The image forming apparatus of claim 9, further comprising:

controlling means for controlling the image forming means and the conveying means; and a jam detecting sensor for detecting that conveyance of the sheet is prevented by the blocking portion, wherein the controlling means stops a sheet conveying operation performed by the conveying means and stops an image forming operation performed by the image forming means when determining that conveyance of the sheet is prevented based on a signal outputted from the jam detecting sensor.

12. The image forming apparatus of claim 9, further comprising controlling means for controlling the image forming means and the conveying means, wherein the conveying means has a pair of rollers for conveying the sheet while cooperatively nipping the sheet, and driving means for rotating at least one roller of the pair of rollers, in a case where successive image formation on a plurality of sheets is made, the controlling means causes the conveying means to stand by in a state in which a second sheet protrudes by a predetermined take-out amount in the sheet conveying direction from a position between the pair of rollers while causing the image forming means to form an image on a first sheet, and the controlling means causes the conveying means to convey the second sheet toward the image forming means after causing the image forming means form an image on the first sheet, and the blocking portion is formed in a position three times or more and five times or less the takeout amount away from the position between the pair of rollers.

13. The image forming apparatus of claim 12, wherein the blocking portion is further disposed on an upstream side of the pair of rollers in the sheet conveying direction.

* * * * *